US009027291B2

(12) United States Patent
Pendley et al.

(10) Patent No.: US 9,027,291 B2
(45) Date of Patent: May 12, 2015

(54) SUPPORT STRUCTURES ON ROOFS

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 13/894,158

(22) Filed: May 14, 2013

(65) Prior Publication Data

US 2013/0239500 A1 Sep. 19, 2013

Related U.S. Application Data

(63) Continuation of application No. 13/066,487, filed on Apr. 14, 2011, now Pat. No. 8,438,801, which is a continuation-in-part of application No. 13/065,172, filed on Mar. 14, 2011, now Pat. No. 8,438,800.

(51) Int. Cl.

| | |
|---|---|
| ***E04D 13/04*** | (2006.01) |
| *E04D 13/03* | (2006.01) |
| *E04D 3/30* | (2006.01) |

(52) U.S. Cl.

CPC ..... *E04D 13/0404* (2013.01); *E04D 13/03* (2013.01); *E04D 13/0305* (2013.01); (Continued)

(58) Field of Classification Search

CPC . E04D 13/03; E04D 13/0305; E04D 13/0315; E04D 13/031; E04D 13/0404; E04D 13/0445; E04D 2013/045; E04D 13/14; E04D 13/147; E04D 13/1478; E04D 13/1473; E04D 13/1475; E04D 3/30; E04D 13/032

USPC ..... 52/90.1, 90.2, 91.1, 200, 302.1, 302.6

See application file for complete search history.

(56) References Cited

U.S. PATENT DOCUMENTS

| | | | | |
|---|---|---|---|---|
| 3,521,414 | A * | 7/1970 | Malissa | 52/107 |
| 3,791,088 | A | 2/1974 | Sandow et al. | |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

FAA Facility, photos of skylight installation, 3 pages, Sacramento, CA, prior to 2007.

(Continued)

*Primary Examiner* — Andrew J Triggs

(74) *Attorney, Agent, or Firm* — Thomas D. Wilhelm; Wilhelm Law, S.C.

(57) ABSTRACT

A roof load support structure supports a load on a roof such that substantially all of the load is conveyed through rails, which are mounted on roof panel ribs, thence through roof panel ribs, and to underlying building support structure. The panel flat between the rails can be unobstructed such that water can flow freely down the panel flat between the rails; or end closures can close off access to the respective panel flat between the end closures and the rails. One such end closure can be an upper diverter at an up-slope end of the support structure. A lower edge of such upper diverter, e.g. at the panel flat, can slope downwardly across a width of the respective roof panel thereby to direct water laterally across the respective roof panel.

5 Claims, 21 Drawing Sheets

(52) U.S. Cl.
CPC ..... *E04D13/031* (2013.01); *E04D 13/032* (2013.01); *E04D 3/30* (2013.01); *E04D 13/0315* (2013.01); *E04D 13/04* (2013.01)

(56) References Cited

U.S. PATENT DOCUMENTS

| | | | | |
|---|---|---|---|---|
| 3,828,494 | A | 8/1974 | Uhrhane et al. | |
| 3,967,423 | A | 7/1976 | Hammond | |
| 4,117,638 | A | 10/1978 | Kidd, Jr. et al. | |
| 4,123,883 | A | 11/1978 | Barber, Jr. et al. | |
| 4,155,206 | A | 5/1979 | Player | |
| D259,812 | S * | 7/1981 | Smith | D25/140 |
| 4,296,581 | A | 10/1981 | Heckelsberg | |
| 4,470,230 | A | 9/1984 | Weisner | |
| 4,520,604 | A | 6/1985 | Halsey et al. | |
| 4,543,753 | A | 10/1985 | Sonneborn et al. | |
| 4,559,753 | A * | 12/1985 | Brueske | 52/748.1 |
| 4,621,466 | A | 11/1986 | Sonneborn et al. | |
| 4,649,680 | A | 3/1987 | Weisner et al. | |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A | 8/1989 | Weisner et al. | |
| 4,941,300 | A | 7/1990 | Lyons, Jr. | |
| 4,986,039 | A | 1/1991 | Weisner | |
| 5,018,333 | A * | 5/1991 | Bruhm | 52/741.4 |
| 5,027,576 | A | 7/1991 | Gustavsson | |
| 5,323,576 | A | 6/1994 | Gumpert et al. | |
| 5,511,354 | A | 4/1996 | Eidson | |
| 5,522,189 | A * | 6/1996 | Mortensen et al. | 52/200 |
| 5,553,425 | A * | 9/1996 | Sampson et al. | 52/58 |
| 5,561,953 | A | 10/1996 | Rotter | |
| 5,896,711 | A * | 4/1999 | McClure | 52/200 |
| 5,960,596 | A | 10/1999 | Lyons, Sr. | |
| 6,079,167 | A | 6/2000 | Voegele, Jr. | |
| 6,151,838 | A * | 11/2000 | Husein | 52/58 |
| 6,640,508 | B2 | 11/2003 | Lindgren et al. | |
| 6,966,157 | B1 | 11/2005 | Sandow | |
| 7,043,882 | B2 | 5/2006 | Gumpert et al. | |
| 7,296,388 | B2 | 11/2007 | Valentz et al. | |
| 7,308,777 | B2 | 12/2007 | Sandow | |
| 7,395,636 | B2 | 7/2008 | Blomberg | |
| 7,712,279 | B2 * | 5/2010 | McClure | 52/580 |
| 7,721,493 | B2 | 5/2010 | Skov et al. | |
| 7,736,014 | B2 | 6/2010 | Blomberg | |
| 8,438,798 | B2 * | 5/2013 | McLain et al. | 52/200 |
| 8,438,799 | B2 * | 5/2013 | McLain et al. | 52/200 |
| 8,438,800 | B2 * | 5/2013 | McLain et al. | 52/200 |
| 8,438,801 | B2 * | 5/2013 | McLain et al. | 52/200 |
| 2004/0049996 | A1 | 3/2004 | Blomberg | |
| 2005/0204674 | A1 | 9/2005 | Marshall | |
| 2006/0191230 | A1 | 8/2006 | Gumpert | |
| 2007/0094984 | A1 | 5/2007 | McClure | |
| 2007/0101665 | A1 | 5/2007 | Sandow | |
| 2008/0040993 | A1 | 2/2008 | Valentz et al. | |
| 2008/0190050 | A1 | 8/2008 | McClure | |
| 2010/0162643 | A1 * | 7/2010 | Blomberg et al. | 52/200 |
| 2011/0252726 | A1 * | 10/2011 | McLain et al. | 52/200 |
| 2011/0252727 | A1 * | 10/2011 | McLain et al. | 52/200 |
| 2012/0233941 | A1 * | 9/2012 | McLain et al. | 52/200 |
| 2012/0233942 | A1 * | 9/2012 | McLain et al. | 52/200 |
| 2013/0167459 | A1 * | 7/2013 | Pendley et al. | 52/200 |
| 2013/0239500 | A1 * | 9/2013 | Pendley et al. | 52/302.1 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-LITE daylighting panels, 1 sheet.
Cross-section of VP TUF-LITE PANEL—attached to the side of SSR rib, 1 sheet.
Cross-section of BUTLER LITE PANEL—attached to the side of MR24 rib, 1 sheet.
Siemens Building, photos of skylight installation, 6 pages, prior to 2007.
R & S Manufacturing and Sales Company, Inc., Standing Seam 24 Light, Quick Installation Instructions, Under/Over Seam Clip, 12 pages, Newbury Park, CA, date unknown.
R & S Manufacturing and Sales Company, Inc., SS 24 Light, The First Truely Thermally Broken Metal Building Skylight, informational sheet, 1 page, Newbury Park, CA, date unknown.
R & S Manufacturing and Sales Company, Inc., Enlarged sketch of metal roof showing the down slope, 1 page, Newbury Park, CA, date unknown.
Daljcon, LLC., Butler Manufacturing, www.daljcon.com, Example of 6 Layer Standing Seam, printed Dec. 11, 2012.

* cited by examiner

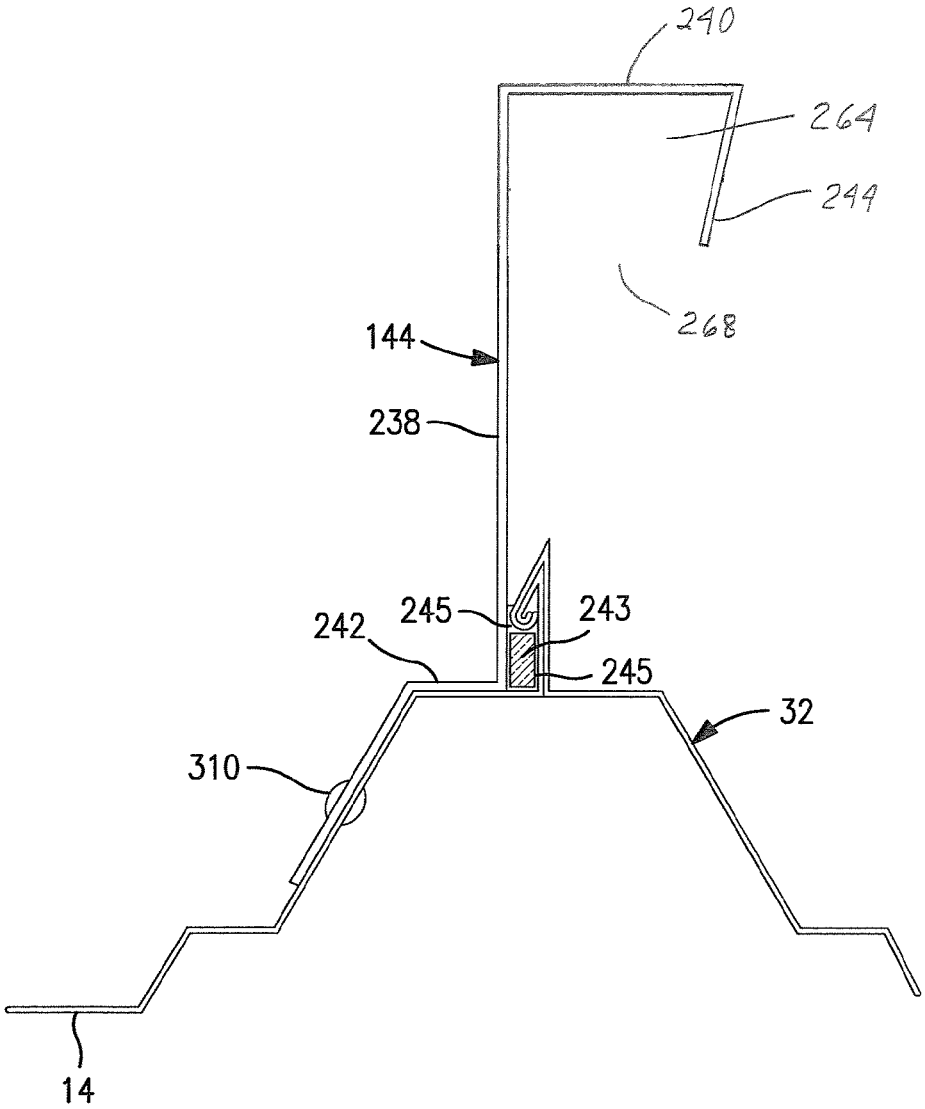
FIG. 8A1

SUPPORT STRUCTURES ON ROOFS

CROSS-REFERENCE TO RELATED APPLICATION

This application is a Continuation application which claims priority under 23 U.S.C. §120 to application Ser. No. 13/066,487, filed Apr. 14, 2011, which claims priority as a Continuation-In-Part application under 23 U.S.C. §120 to application Ser. No. 13/065,172, filed Mar. 14, 2011.

BACKGROUND OF THE INVENTION

Various systems are known for supporting loads on roofs, and for installing skylights and/or smoke vents onto, into roofs.

Commonly used skylighting systems have translucent or transparent closure members, also known as lenses, mounted on a support structure which extends through an opening in the roof and is mounted to building support members inside the building. Ambient daylight passes through the lens and thence through the roof opening and into the building.

Thus, conventional skylight and smoke vent installations use a complex structure beneath the exterior roofing panels and inside the building enclosure, in order to support a curb which extends through the roof and supports the skylight lens. Conventional skylight curbs, thus, are generally in the form of a preassembled box structure surrounding an opening which extends from the top of the box structure to the bottom of the box structure. Such box structure is mounted to building framing members inside the building enclosure, and extends through a respective opening in the roof, similar in size to the opening which extends through the box structure. The skylight assembly thus mounts inside the building enclosure, and extends through an opening in a separately mounted roof structure. Fitting skylight assemblies into such roof opening, in a separately-mounted roof structure, presents problems. All known conventional structures have a tendency to leak water when subjected to rain.

In light of the leakage issues, there is a need for a more effective way to support skylights and smoke vents, thus to bring daylight into buildings, as well as a more effective way to support a variety of other loads, on roofs.

To achieve desired levels of daylighting, conventional skylight installations use multiple roof openings spaced regularly about the length and width of a given roof surface through which daylight is to be received. Each skylight lens is installed over a separate such opening; and the opening for each such skylight assembly, each representing a single lens, extends across multiple elongate metal roof panels.

The opposing sides of conventional metal roof panels, to which skylight assemblies of the invention are mounted, are raised above elongate centralized panel flats which extend the lengths of the panels, whereby the sides of adjacent such roof structures are joined to each other in elongate joints, referred to herein as ribs. The opening for a conventional skylight cuts across multiple such ribs in order to provide a large enough opening to receive conventionally-available commercial-grade skylight assemblies. The skylight assembly, itself, includes a curb which is mounted inside the building and extends, from inside the building, through the roof opening and about the perimeter of the opening, thus to support the skylight lens above the flats of the roof panels, as well as above the ribs. Conventional pliable tube construction sealants are applied about the perimeter of the roof opening, between the edges of the roof panels and the sides of the skylight assembly curb, including at the cut ribs. Typically, substantially all of such sealant is applied in the panel flats, which means that such sealant is the primary barrier to water leakage about substantially the entire perimeter of the skylight curb. One of the causes of roof leaks around the perimeter of conventional roof curbs which attach primarily through the panel flat at the water line is due to foot traffic, such as heel loads or other dynamic loads imposed by workers wheeling gas cylinders or other heavy equipment on the roof panel e.g. with dollies. This type of dynamic loading can cause high levels of stress on the joints that rely solely on tube sealant to provide seals in the wet areas, namely in the panel flats. Such leaks are common around fastener locations as the panels flex under load and cause the sealant to deform such that, in time, passages develop through the sealant, which allows for the flow of water through such passages.

Such multiple curbs, each extending through a separate roof opening, each sealed largely in the panel flats, create multiple opportunities for water to enter the interior of the building. Applicants have discovered that such opportunities include, without limitation, (i) the number of individual openings in the roof,
(ii) the widths of the openings which require cuts through the multiple ribs,
(iii) the tendency of water to collect and stay at the upper end of the curb,
(iv) the disparate expansion and contraction of the roof panels relative to the skylight curb; and
(v) the lengths of sealed seams in the panel flats.

The traditional curb constructions and methods of attachment in most cases thus require that a complicated support structure be installed below the metal roofing and inside the building enclosure, which allows disparate/discordant movement of the metal roof panels and the skylight assembly relative to each other, as associated with thermal expansion and contraction of the metal roof e.g. in response to differences in temperature changes inside and outside the building.

In addition, conventional curb-mounted skylights tend to accumulate condensation, especially about fasteners which extend from the outside of the building to the inside of the climate-controlled building envelope.

Thus, it would be desirable to provide a skylight system which provides a desired level of daylight in a commercial and/or industrial building while substantially reducing the incidence/frequency of leaks occurring about such skylights, as well as reducing the incidence/frequency of condensate accumulation in the areas of such skylights.

It would also be desirable to provide a smoke vent system while substantially reducing the incidence/frequency of leaks occurring about such smoke vents, as well as reducing the incidence/frequency of condensate accumulation in the areas of such smoke vents.

It would further be desirable to provide a support system, suitable for supporting roof loads, up to the load-bearing capacity of the metal roof while substantially controlling the tendency of the roof to leak about such support systems, as well as reducing the incidence/frequency of condensate accumulation in the areas of such closure support systems.

SUMMARY OF THE INVENTION

The invention provides a curbless construction system for installing loads, optionally skylights and/or smoke vents, or other loads, on the major rib elevations of a building's metal roof panel system such that substantially all of the load is conveyed through side rails mounted on roof panel ribs, thence through the ribs and to underlying building support structure, thereby utilizing the beam strengths of the rib elements of the roof panels as an integral part of the support structure supporting such loads.

As used herein "beam strength" refers to the capability of a structural element to resist a bending force, as defined at www.wikipedia.org. Within this context, the ribs in a standing seam metal panel roof provide beam strength in resisting vertical loads imposed on the roof.

In addition, the invention further improves control of water leakage and condensation formation inside the climate-controlled building envelope by refining the design of the upper diverter to close off corners where the upper diverter meets the side rails.

In a first family of embodiments, the invention comprehends a sloping metal roof on a building, the sloping metal roof comprising a plurality of elongate metal roof panels arranged side by side, such roof panels having lengths, edges of adjacent such roof panels meeting at elevated rib structure portions thereof, whereby such roof panels thereby define elevated roof panel ribs, having lengths, panel flats being disposed between such elevated roof panel ribs, a load being mounted on such roof, the load being supported by a load support structure, the load support structure comprising first and second rails having lengths extending in a same direction as the lengths of the roof panel ribs, first and second ones of the roof panel ribs underlying, and supporting, the first and second rails, whereby substantially all of the load is conveyed through the ribs to a structural support system of such building, the load extending between the first and second rails across at least one such panel flat.

In some embodiments, a such panel flat between the first and second rails is sufficiently unobstructed proximate the load that rain water can freely flow down such panel flat between the first and second rails.

In some embodiments, end closures are disposed at upper and lower ends of the load support structure, the end closures extending between the first and second rails and closing off access to the respective roof panel between the end closures and the first and second rails.

In some embodiments, the end closures comprise an upper diverter at the up-slope end of the load support structure and a lower closure at the down-slope end of the load support structure.

In some embodiments, a lower edge of an end panel of the upper diverter defines a downwardly-directed slope extending across a width of the respective metal roof panel thereby to direct water, flowing by gravity toward the load support structure, laterally across the respective metal roof panel at the upper diverter.

In a second family of embodiments, the invention comprehends apparatus adapted to be assembled to form a support structure overlying a portion of a sloping metal roof on a building, wherein the support structure defines a wall, the roof of the building comprising a plurality of elongate metal roof panels which collectively define a plurality of upstanding ribs, and panel flats between the ribs, the wall extending up from the roof, the apparatus comprising a first elongate side rail; a second elongate side rail; and an upper diverter, the upper diverter comprising an end panel extending between the first and second side rails and facing up-slope along the roof, diverter ears extending from the end panel and being folded over the first and second side rails on a fold line which is generally perpendicular to the panel flat.

BRIEF DESCRIPTION OF THE DRAWINGS

A more complete understanding of the present invention and the attendant features and advantages thereof may be had by reference to the following detailed description when considered in combination with the accompanying drawings wherein various figures depict the components and composition of the support structure of the invention.

FIG. 8A1 is an enlarged end view of a rail mounted on a rib, and illustrating a gap plug in the space between the upstanding web of the rail and the metal roof standing seam, under the turned-over edges of the standing seam.

Figure 1:
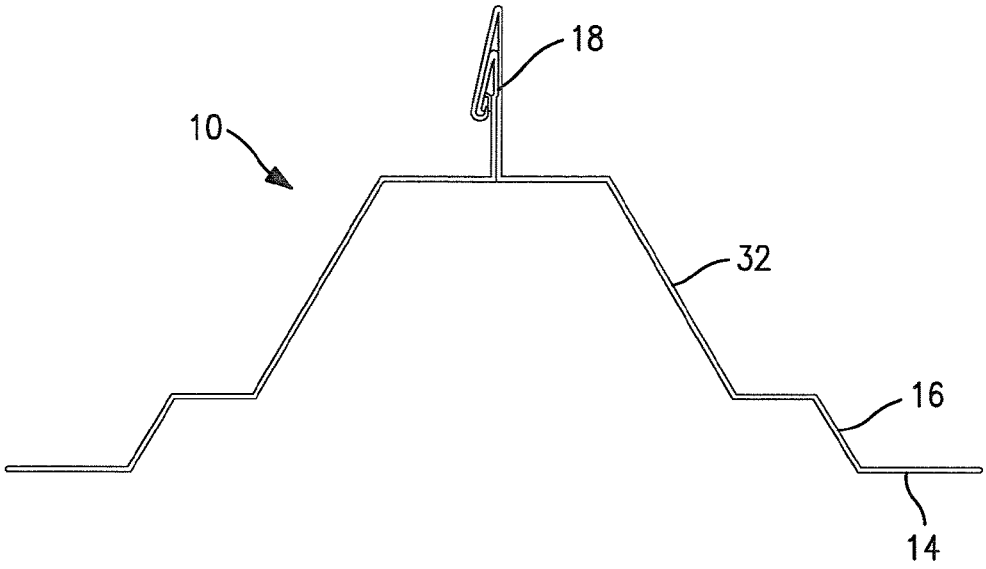
FIG. 1 is a roof profile of a metal roof of the type known as the standing seam roof.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a load support structure, for use in installing various exterior roof loads, including structures which close off openings in metal roofs. For purposes of simplicity, "support structure" will be used interchangeably to mean various forms of structures which are mounted on ribs of raised elevation metal roof structures, which may surround an opening in the roof, including across the flat of a roof panel, and which support e.g. a closure over the opening, or a conduit which extends through the roof opening. Skylight assemblies and smoke vents are non-limiting examples of closures over such roof openings. Air handling operations such as vents, air intake, and air or other gaseous exchange to and/or from the interior of the building are non-limiting examples of operations where conduits extend through the roof opening. In the case of roof ventilation, examples include simple ventilation openings, such as for roof fans, and smoke vents, which are used to allow the escape of smoke through the roof during fires. In the case of exterior loads on the roof, where no substantial roof opening is necessarily involved, there can be mentioned, without limitation, such loads as air conditioners, air handlers, solar panels and other equipment related building utilities, and/or to controlling water or air temperatures inside the building. The only limitation regarding the loads to be supported is that the magnitude of a load must be within the load-bearing capacity of the roof panel or panels to which the load is mounted.

The number of skylights or other roof loads can vary from one load structure, to as many load structures as the building roof can support, limited only by the amount of support available from the respective roof panels to which the load is attached.

The invention provides structure and installation processes, as a closure system which utilizes the beam-like strength of the standing seams, in the roof panels, as the primary support, supporting e.g. a downwardly-directed load on the roof.

One family of support structures of the invention comprehends a skylight system which does not require support from the building framing inside the climate-controlled building enclosure for the purpose of supporting the skylight installation. Neither does the skylight system of the invention require a separate curb construction surrounding each skylight lens assembly to separately support or mount or attach each skylight lens assembly to the roof. Rather, the support structure of the invention, which supports such skylights, is overlaid onto, and mounted to, the roof panels, and exposes the support structure to the same ambient weather conditions which are experienced by the surrounding roof panels, whereby the support structure experiences approximately the same thermal expansions and contractions as are experienced by the respective roof panel or panels to which the support structure is mounted. This is accomplished through direct attachment of the support structures of the invention, which support a skylight assembly, to the underlying metal roof panels. According to such roof mounting, and such ambient weather exposure, expansion and contraction of the support structure of the invention generally coincides, at least in direction, with concurrent expansion and contraction of the metal roof panels.

Referring now to the drawings, a given metal roof panel generally extends from the peak of the roof to the respective eave. Skylight systems of the invention contemplate the installation of two or more adjacent skylight assemblies in an end to end relationship along the major rib structure of a given such metal roof panel on the building whereby the individual skylight assemblies are installed in strips over a continuous, uninterrupted opening in the metal roof, the opening extending along a line which extends from the roof ridge to a corresponding eave.

Skylight systems of the invention can be applied to various types of ribbed roof profiles. FIG. 1 is an end view showing a roof profile of a metal roof of the type known as a standing seam roof. These include the "standing seam" roof, which has trapezoidal elevated elongate major ribs 32 typically 24" to 30" on center. Each roof panel 10 also includes a panel flat 14, and may include a shoulder 16 between a rib 32 and the panel flat. The elevated ribs on a given panel cooperate with corresponding elevated elongate ribs on next-adjacent panels, thus forming standing seams 18. Seams 18 represent the edges of adjacent roof panels, folded one over the other, to form elongate joints at the side edges of the respective roof panels. The edge regions of the rib elevations on respective adjacent panels are, together, folded over such that the standing seam functions as a folded-over raised joint between the respective panels, thus to inhibit water penetration of the roof at the standing seam/joint.

Figure 2:
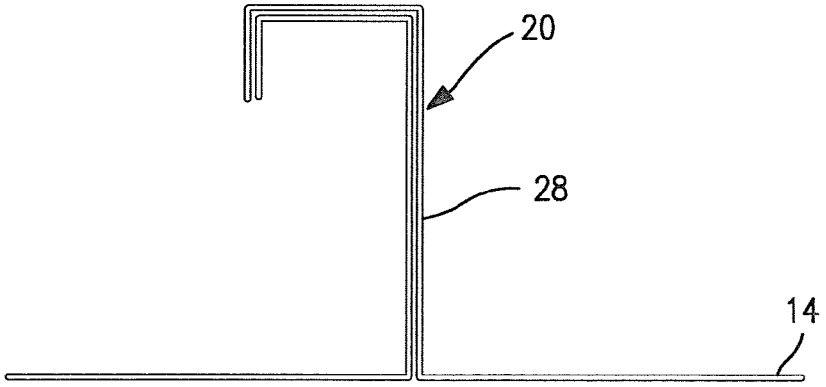
FIG. 2 is a roof profile of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 14, and a rib element of an architectural standing seam 28 on each side of the panel.

Figure 3:
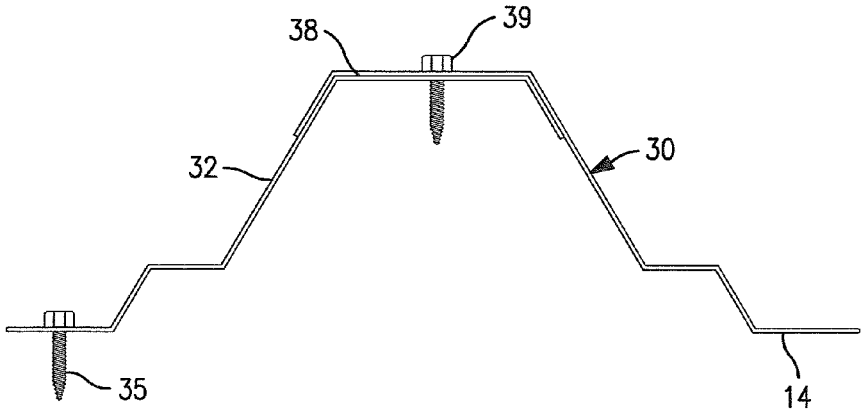
FIG. 3 is a roof profile of a metal roof of the type commonly referred to as an exposed fastener roof.

FIG. 3 is an end view showing the roof profile of a metal roof of the type commonly referred to as an "R panel" or exposed fastener panel 30. Each panel has elements on opposing sides of a panel flat 14 which, with the rib elements of adjacent panels, form ribs 32. Adjacent R panels are secured to the roof by fasteners 35. At side lap 38, overlapping regions of adjacent panels are secured to each other by stitch fasteners 39. Trapezoidal major ribs of the R panel roof are most typically formed at 8 inches to 12 inches on center.

Figure 4:
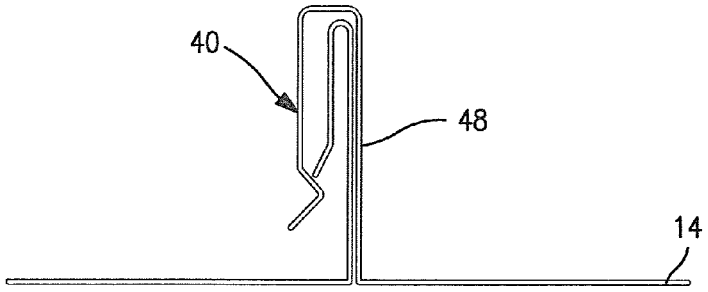
FIG. 4 is a roof profile of a metal roof of the type commonly referred to as a snap seam roof.

FIG. 4 is an end view showing the roof profile of a metal roof of the type commonly referred to as a snap rib seam panel 40. Snap seam panels 40 have a panel flat 14 and a standing seam or snap seam 48 where the adjacent panels meet.

Figure 5:
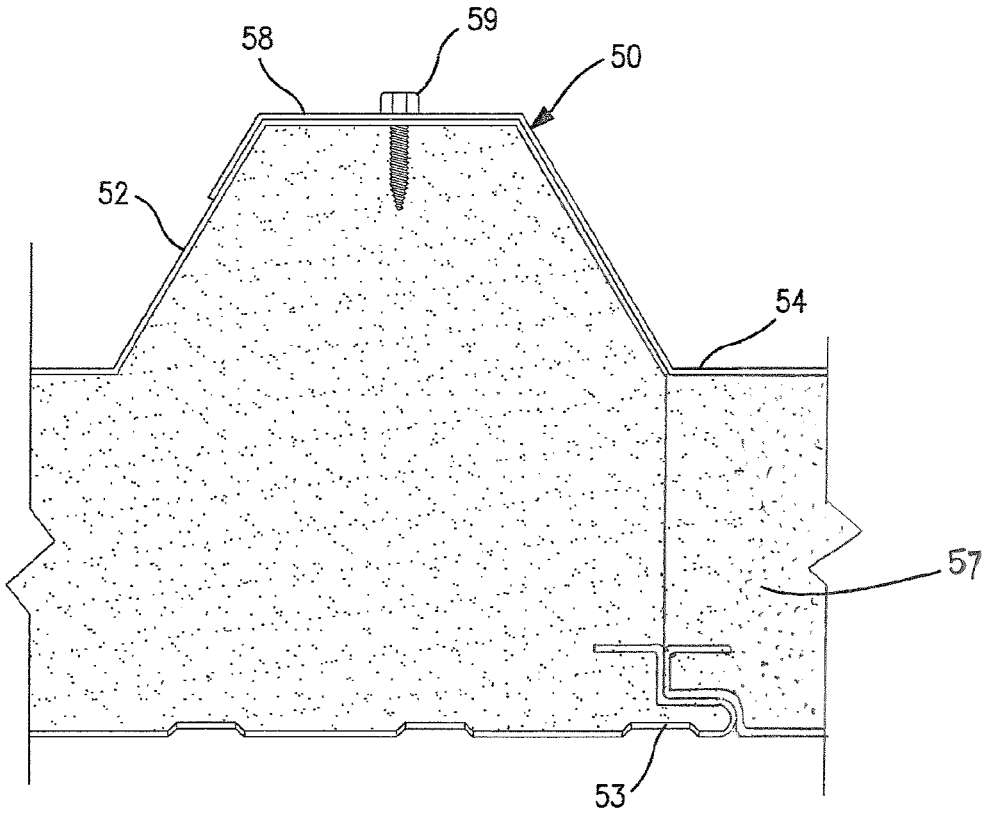
FIG. 5 is a roof profile of a metal roof of the type commonly known as a foam core roof.

FIG. 5 is an end view showing a roof profile of a metal roof of the type commonly referred to as a foam core panel 50. Such roof has a rib 32, a liner panel 53, a panel flat 14 and a foam core 57. Overlapping regions 58 of adjacent panels are secured to each other by fasteners 59.

A skylight/ventilation support structure is illustrative of support structures of the invention which close off roof-penetrating openings. Such support structure can comprise a rail and closure structure which surrounds an opening in the roof, and which is adapted to be mounted on, and supported by, the prominent standing elevations, standing rib structures, or other upstanding elements of conventional such roof panels, where the standing structures of the roof panels, namely structure which extends above the panel flats, e.g. at seams/joints where adjoining metal roof panels are joined to each other, provides the support for the support structures. A such rail and closure support structure is secured to the conventional metal roof panels, and surrounds a roof opening formed largely in the intervening flat region of a single metal roof panel.

Figure 6:
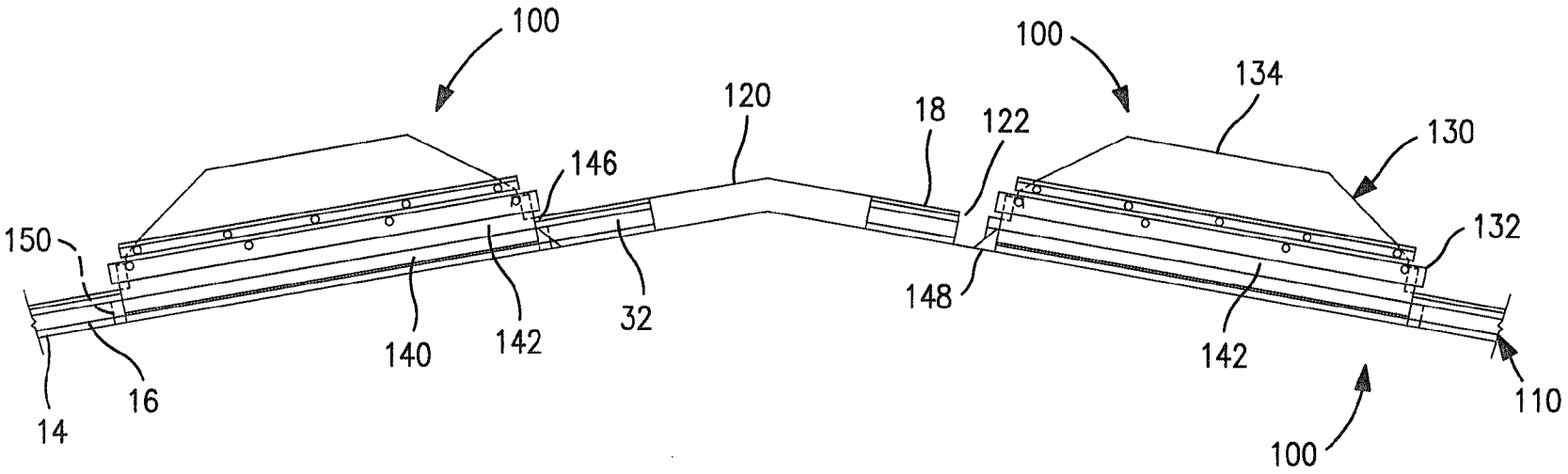
FIG. 6 is a side view showing major components of a skylight system of the invention, installed on a metal roof.

FIG. 6 shows first and second exemplary support structures 100, mounted to a standing seam panel roof 110, and overlain by covers defined by first and second skylight lens assemblies 130.

Figure 7:
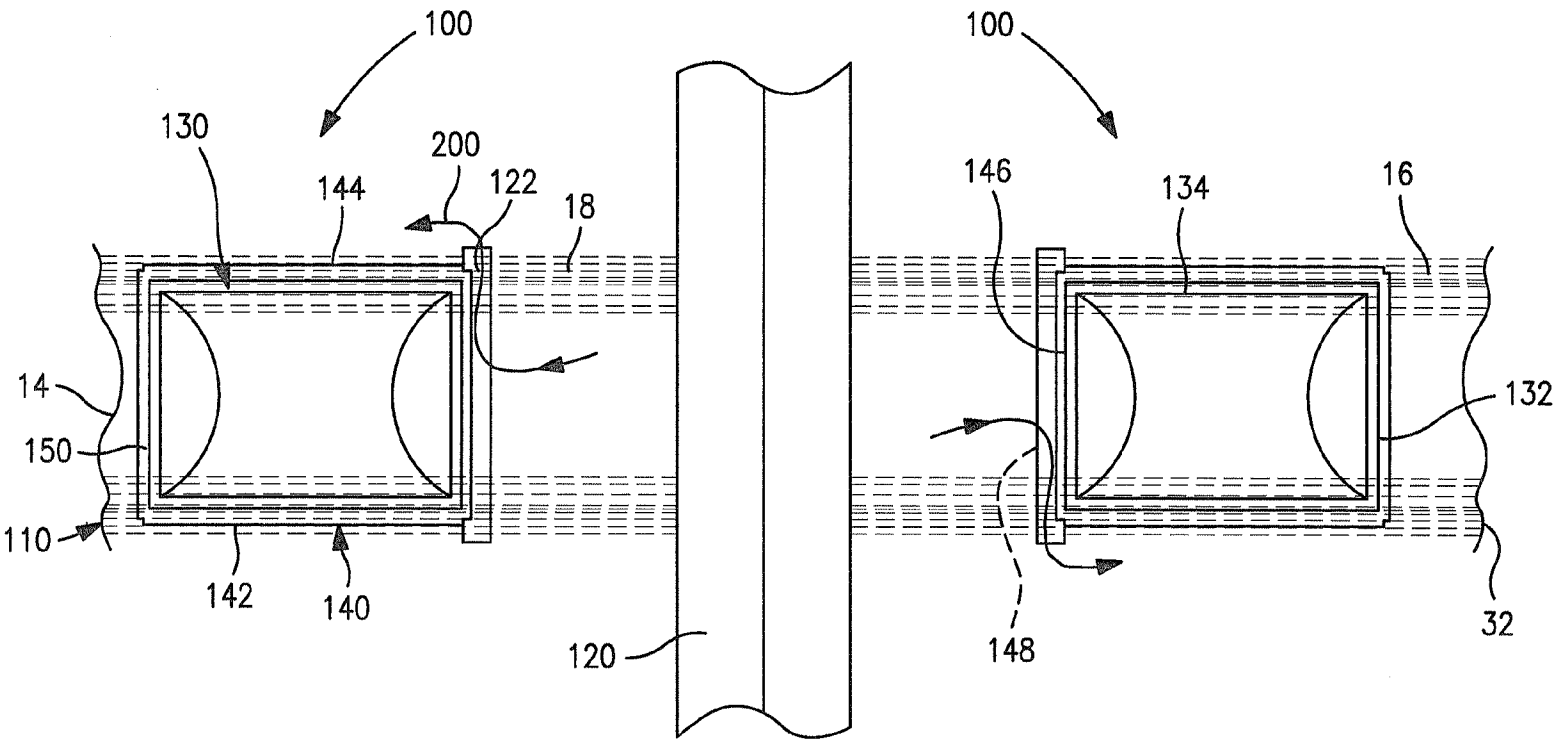
FIG. 7 is a top plan view of the installed skylight system of FIG. 6, showing placement of the skylights and the direction of water flow around the skylights.

FIG. 7 shows a portion of the roof 110 of FIG. 6, in dashed outline. The roof has raised ribs 32, panel flats 14, shoulders 16 and standing seams 18. Given that water generally seeks the lowest level available at any given location, any water on a given roof panel tends to congregate/gather on the upper surface of the panel flat whereby, except for any dams across the panel flat, the water line is generally limited to the panel flat and slightly above the panel flat. Thus, most of shoulder 16, and all of rib 32 above shoulder 16, and all of standing seam 18, are all typically above the water line. Also depicted in FIGS. 6 and 7 are ridge cap 120 of the roof structure, and cutaway regions, or gaps 122 in the raised ribs 32.

Skylight lens assembly 130, which is part of the closure system for closing off the opening, generally comprises a skylight lens frame 132 mounted to the closure support structure and extending about the perimeter of a given closure support structure, in combination with a skylight lens 134 mounted to frame 132. An exemplary such skylight lens is that taught in U.S. Pat. No. 7,395,636 Blomberg and available from Sunoptics Prismatic Skylights, Sacramento, Calif.

Figure 7A:
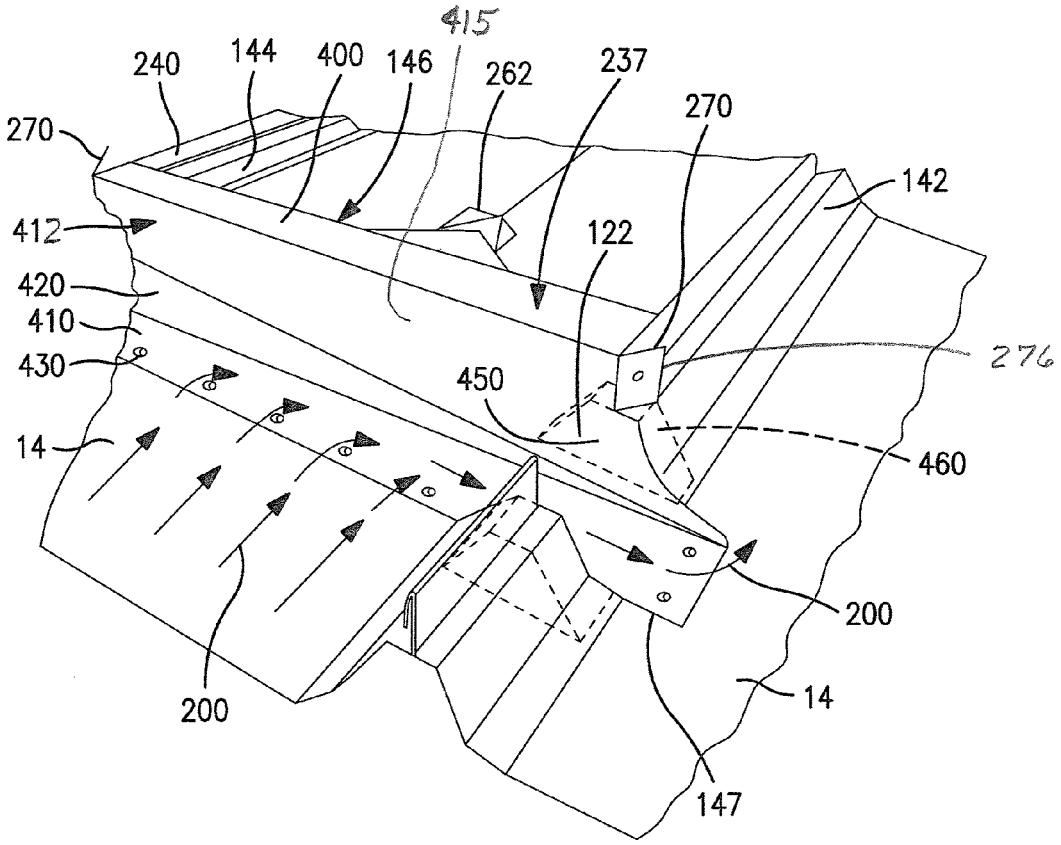
FIG. 7A is a cut-away pictorial view showing the upper diverter mounted in the rib gap.

Still referring to FIGS. 6, 7, and 7A, support structure 100 of the invention, as applied to a skylight installation, includes a rail and closure structure 140. Such rail and closure structure includes one or more first side rails 142 and one or more second side rails 144 (FIGS. 8A, 8A1), upper diverter 146 disposed adjacent rib gap 122, and a lower closure 150. As shown in FIG. 7A, a lateral leg 147 of the upper diverter is located in gap 122, filling the bottom, and the lower side, of the gap and carrying water laterally across the width of the respective rib, to the panel flat 14 of the adjacent roof panel, thus to convey the water away from the upper end of the skylight and to prevent the water from leaking through the roof opening. Rail and closure structure 140 also includes support plates, connectors, bridging members, and rubber or plastic plugs to make various connections to the rail and closure structure elements as well as to close gaps/spaces between the various rail and closure structure elements, and between the roof panels and the rail and closure structure elements, thus to complete the seals which prevent water leakage about the skylight and its associated opening in the roof.

FIGS. 7 and 7A show how gap 122 in rib 32, in combination with upper diverter 146, provides for water flow, as illustrated by arrows 200, causing the water to move laterally along the roof surface, over lateral leg 147 of the upper diverter, and down and away from the roof ridge cap 120 in panel flat 14 of the roof panel which is next adjacent the roof structures which support the respective e.g. skylight.

Lower closure 150 closes off the roof opening from the outside elements at the lower end of the e.g. skylight or strip of skylights, thus to serve as a barrier to water leakage at the lower end of the opening in the roof.

Figure 8A:
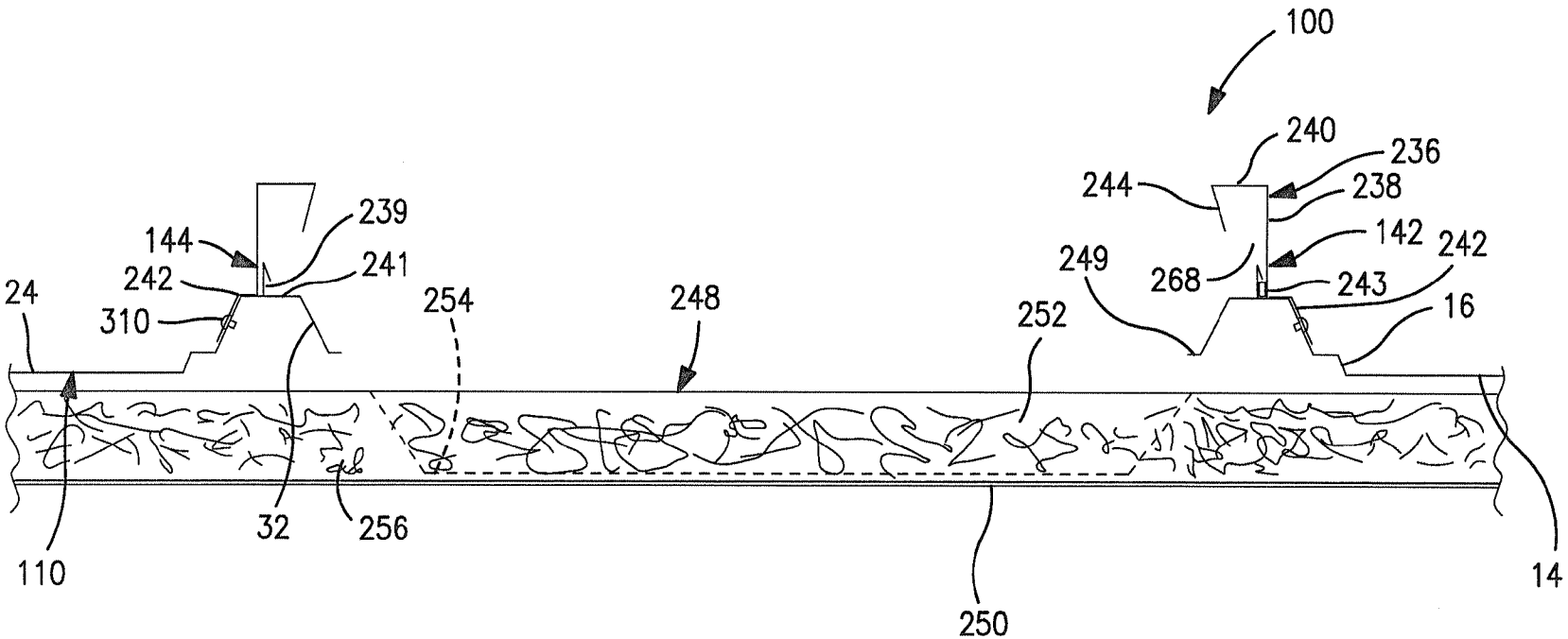
FIG. 8A is a cross sectional view showing the connections of the rails to the rib elevations of a metal panel roof where the panel flat has been removed, including showing the underlying building insulation.

Referring now to FIGS. 8A and 8A1, a cross section through rib 32, and associated support structures 100 shows securement of support structures 100 to standing rib portions of the standing seam panel roof 110. FIG. 8A depicts the use of ribs 32 to support side rails 142 and 144 on opposing sides of the panel flat 14. Each rail 142 or 144 has a lower rail shoulder 242 and a rail upper support structure 236. Rail upper support structure 236 has a generally vertically upstanding web 238, a generally horizontal rail upper flange or bearing panel 240, and a rail inside panel 244. Inside panel 244 extends toward outer panel 238 at an included angle of about 75 degrees between panel 240 and panel 244. From web 238, shoulder 242 extends laterally at a perpendicular angle over rib 32 as a shoulder top, and turns at an obtuse included angle down, tracking the angle of the side of rib 32. The rail is secured to the side of rib 32 by fasteners 310 spaced along the length of the rib.

As illustrated in FIGS. 8A and 8A1, in each rib joint, the edges of the two roof panels are folded together, one over the other, leaving a space 239 between the bottom edges of the folded over panel edges and the underlying top flat surface 241 of the rib. Where the space 239 faces web 238 of the rail, as at the right side of FIG. 8A, and as shown in FIG. 8A1, a gap plug 243 is disposed in space 239 between the standing seam and under the turned-over edge, and the outer panel of the rail. Gap plugs 243 are used both where the upper diverter meets the side rails and where the lower closure meets the side rails.

Where space 239 faces away from upstanding web 238 of the side rail, as at the left side of FIG. 8A, the flat surface of upstanding web 238 can be brought into a close enough relationship with the standing seam that any spaces between the standing seam and the upstanding web can be dosed by pliable tube sealants. Thus, no gap plug is typically used between upstanding web 238 and the standing seam where the edge of the seam is turned away from the upstanding web.

Gap plug 243 is relatively short, for example about 1.5 inches to about 2.5 inches long, and has a width/height cross-section, shown in FIG. 8A1, which loosely fills space 239. The remainder of the space 239, about plug 243, namely between plug 243 and upstanding web 238, and between plug 243 and the standing seam, is filled with e.g. a pliable construction sealant 245. Such sealant is shown in FIG. 8A1 as white space about plug 243. Plug 243 thus provides a solid fill piece at spaces 239 where there is some risk of water entry into the roof opening, and where the space 239 is too large for assurance that a more pliable sealant can prevent such water entry.

A gap plug 243 is made of a relatively solid, yet resilient, e.g. EPDM (ethylene propylene diene monomer) rubber, which provides relatively solid e.g. relatively non-pliable mass in space 239 between the folded-over standing seam, and upstanding web 238 of the rail, and relatively pliable, putty-like, tape mastic and tube caulk or the like are used to fill the relatively smaller spaces which remain after the gap plug has been inserted in the respective gap/space. Bearing panel 240, at the top of the rail, is adapted to support skylight frame 132, seen in FIG. 8D. Inside panel 244 of the rail extends down from the inner edge of bearing panel 240 at an obtuse included angle, illustrated at about 135 degrees.

Referring back to FIG. 8A, insulation 248 is shown below the opening 249 in the metal roof panel. Insulation 248 has a facing sheet 250 underlying a layer of e.g. fiberglass batt material 252. Dashed line 254 outlines the approximate portion of the fiberglass batt material which is to be removed. An edge portion 256 of batt material is left extending into opening 249 for use described e.g. with respect to FIG. 8C.

Rail and closure structure 140 is representative of support structure 100. Rails 142, 144 fit closely along the contours of ribs 32. Upper diverter 146 and lower closure 150 have contours which match the cross-panel contours of the respective ribs 32 as well as flats 14, 114. The various mating surfaces of structure 140 and roof 110 can be sealed in various ways known to the roofing art, including caulk or tape mastic. Plastic or rubber fittings or inserts such as plugs 243 and 460 can be used to fill larger openings at the rails and ribs.

Figure 8B:
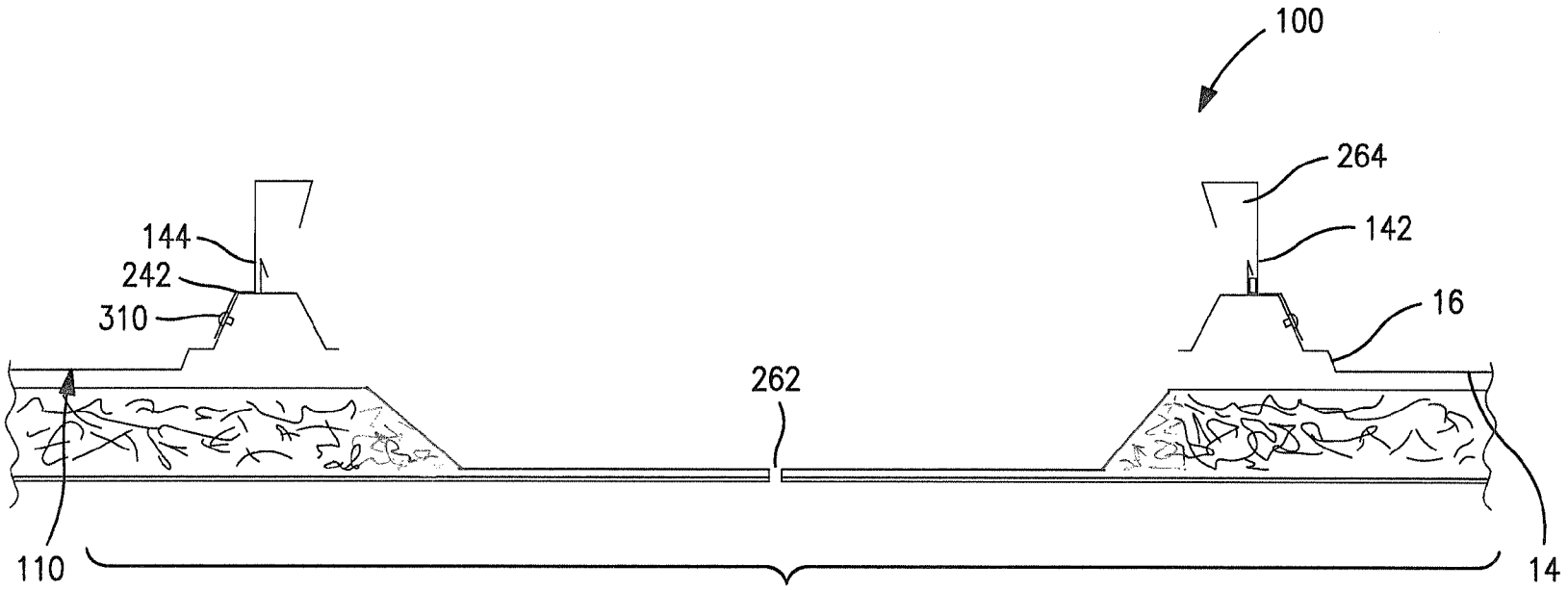
FIG. 8B shows a cross-section as in FIG. 8A, after removal of that portion of the insulation which was to be removed, and the insulation facing sheet cut along the length of the opening in the metal roof.

FIG. 8B shows the insulation batt material, marked with a dashed outline in FIG. 8A, removed from its position under the central portion of the opening in the metal roof panel, cleaning almost all of the batt material from that portion of the facing sheet. The facing sheet is then cut the full length of the roof-penetrating opening 249 over which the one or more skylight lenses are to be installed. At the ends of opening 249, the cut is spread to the corners of the opening. A such "Y"-shaped shaped cut 262 is illustrated at the upper end of the opening in FIG. 7A, wherein the ends of the "Y" extend to approximately the upper corners of the opening.

Figure 8C:
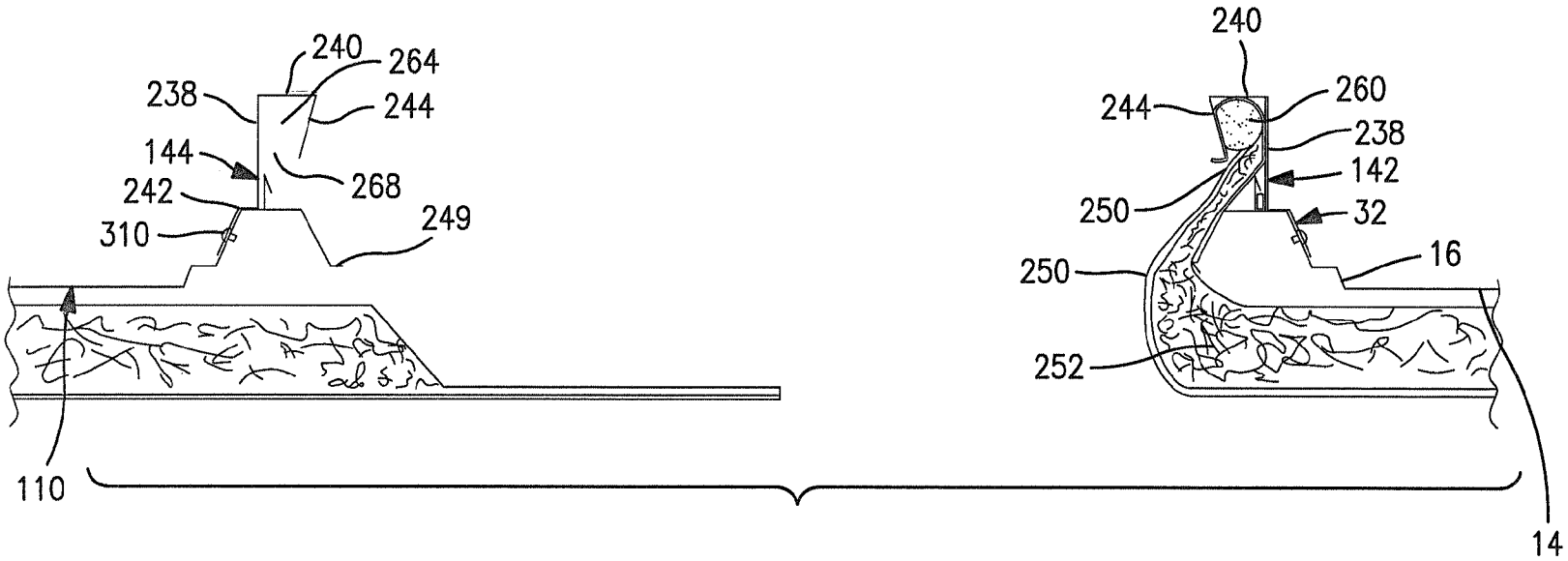
FIG. 8C shows a cross-section as in FIGS. 8A and 8B wherein the insulation facing sheet on one side of the opening has been raised and tucked into the cavity in the rail, and is being held in the cavity by a retainer rod.

FIG. 8C shows one side of the facing sheet lifted out of the opening 249. The facing sheet and edge portion 256 of the insulation batting have been raised. A resilient foam retaining rod 260 has been forced into cavity 264 in the rail, with the facing sheet captured between the retaining rod and the rail surfaces which define cavity 264, which holds the insulation batting of edge portion 256 against the respective rib 32. Facing sheet 250 enters cavity 264 against upstanding web 238 of the rail, extends up and over/about rod 260 in the cavity, and thence extends back out of cavity 264 to a terminal end of the facing sheet outside cavity 264. Thus, rod 260 holds edge portion 256, as thermal insulation, against rib 32, and also positions the facing sheet vapor barrier between the climate-controlled space 266 inside the building and the perimeter of the support structure.

The uncompressed, rest cross-section of rod 260 in cavity 264 is somewhat greater than the slot-shaped opening 268 between inside panel 244 and upstanding web 238. Thus retainer rod 260 necessarily is deformable, and the cross-section of the rod is compressed as the rod is being forced through opening 268. After passing through opening 268, rod 260 expands against panels 238, 240, 244 of the cavity while remaining sufficiently compressed to urge facing sheet 250 against web 238 and panels 240 and 244 of the cavity whereby facing sheet 250 is assuredly retained in cavity 264 over the entire length of the rail or rails. A highly resilient, yet firm, polypropylene or ethylene propylene copolymer foam is suitable for rod 260. A suitable such rod, known as a "backer rod" is available from Bay Industries, Green Bay, Wis.

Upper diverter 146 and lower closure 150, discussed in more detail hereinafter, extend across the flat of the metal roof panel adjacent the upper and lower ends of roof opening 249 to complete the closure of support structure 100 about the perimeter of the skylight opening. The upper diverter and the lower closure have rail upper support structures 237 having cross-sections corresponding to the cross-sections of upper support structures 237 of rails 142. 144. Those upper support structures thus have corresponding flange cavities which are used to capture facing sheet 250 at the upper diverter and lower closure. Thus, the facing sheet is trapped in a cavity at the upper reaches of the rail and closure structure about the entire perimeter of the rail and closure structure. Bridging tape or the like is used to bridge between the side portions and end portions of insulation facing sheet 250 at the "Y" cuts at the ends of support structure 100, such that the facing sheet completely separates the interior of skylight cavity 274 from the respective elements of support structure 100 other than inside panel 244.

Figure 8D:
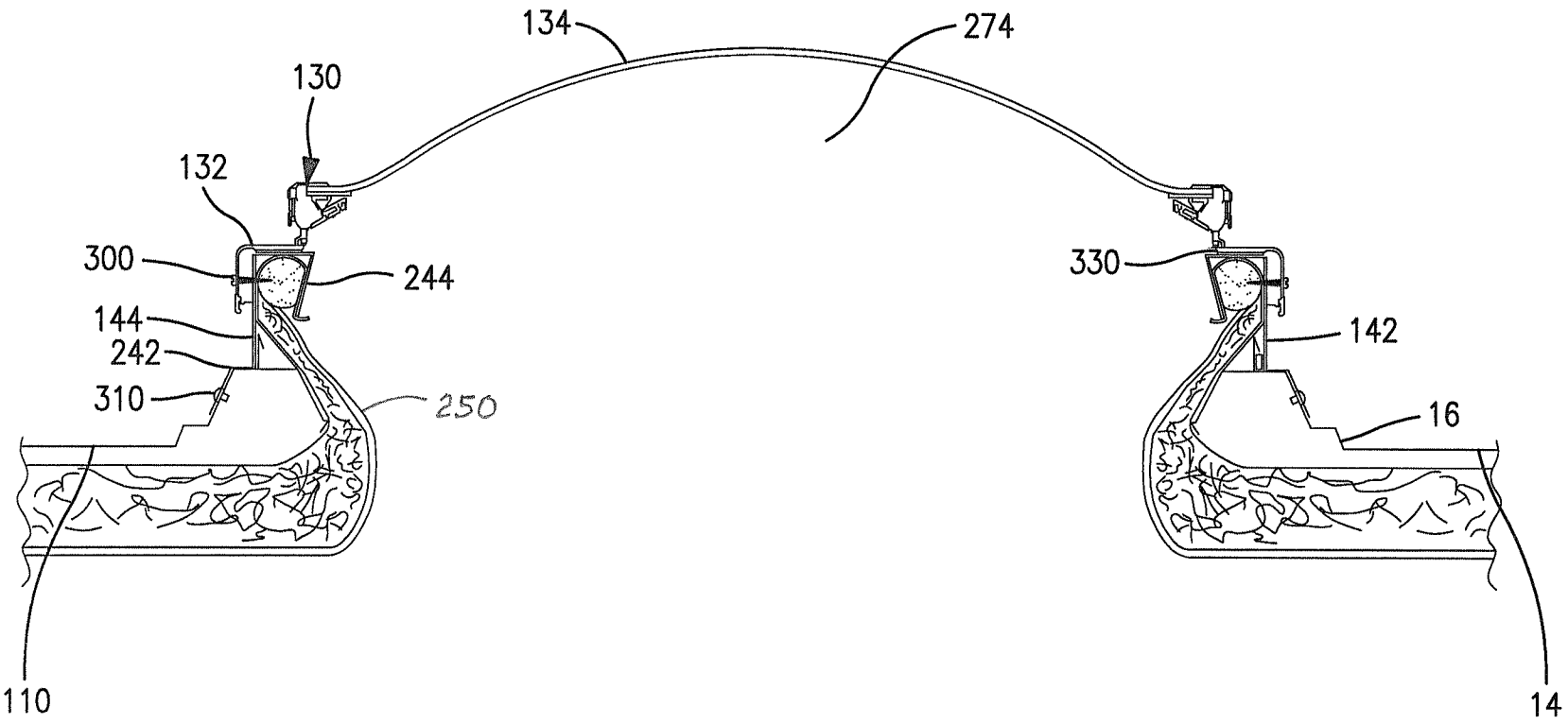
FIG. 8D shows a cross-section as in FIGS. 8A-8C wherein the facing sheet on both sides of the opening has been tucked into the rail cavity and is being held in the cavity by the retainer rod shown in FIG. 8C; and the skylight lens subassembly has been mounted to the rails, serving as a cover over the opening in the metal roof.

FIG. 8D shows facing sheet 250 trapped in the rail cavities on both sides of the roof opening. FIG. 8D further shows the skylight subassembly, including frame 12 and lens 134, mounted to rails 142, 144. A sealant 330 is disposed between bearing panel 240 and skylight frame 132, to seal against the passage of water or air across the respective joint. A series of fasteners 300 extend through upstanding web 238 of the rail and extend into resilient rod 260, whereby rod 260 insulates the inside of the roof opening from the temperature differential, especially cold, transmitted by fasteners 300, thereby to avoid fasteners 300 being a source of condensation inside the skylight cavity 274, namely below the skylight lens.

Figure 9:
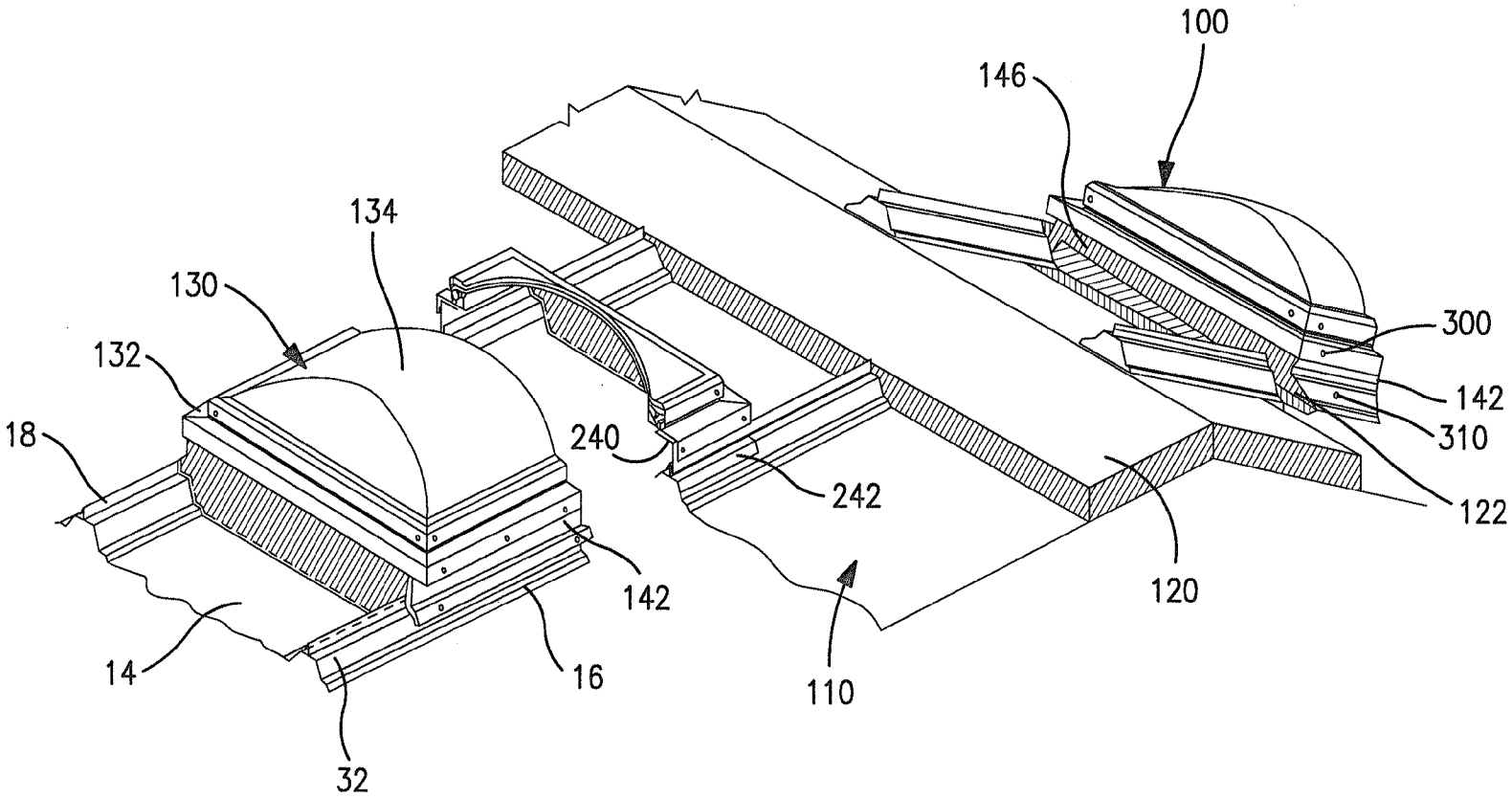
FIG. 9 is a perspective view partially cut away showing internal structure of the system as installed on the rib elevations of a metal panel roof.

In FIG. 9 a partially cut away perspective view of rail and closure structures 140 is used to show support of the rail and closure structure by standing seam panel roof 110, particularly the elevated rib 32 providing the structural support at the standing seams. FIG. 9 illustrates how the rail and closure structures cooperate with the structural profiles of the roof panels of the metal roof structure above and below the skylights, including following the elevations and ribs in adjacent ones of the panels, and thereby providing the primary support, by the roof panels, for the loads imposed by the skylights. In this fashion, the support structures of the invention adopt various ones of the advantages of a standing seam roof, including the beam strength features of the ribs at the standing seam, as well as the water flow control features of the standing seam.

Most standing seam roofs are seamed using various clip assemblies that allow the roof panels to float/move relative to each other, along the major elevations, namely along the joints between the respective roof panels, such joints being defined at, for example, elevated ribs 32. By accommodating such floating of the panels relative to each other, each roof panel is free to expand and contract according to e.g. ambient temperature changes irrespective of any concurrent expansion or contraction of the next-adjacent roof panels. Typically, a roof panel is fixed at the eave and allowed to expand and contract relative to a ridge. In some roofs, the panels are fixed at midspan, whereby the panels expand and contract relative to both the eave and ridge.

The design of the skylight systems of the invention takes advantage of such floating features of contemporary roof structures, such that when skylight assemblies of the invention are secured to respective rib elevations as illustrated herein, the skylight assemblies, themselves, are supported by the roof panels at ribs 32. Thus, the skylight assemblies, being carried by the roof panels, move with the expansion and contraction of the respective roof panels to which they are mounted.

FIG. 9 shows panel flat 14, rib 32, and shoulder 16, as well as standing seam 18. Ridge cap 120 is shown at the roof peak. Gap 122 in a rib 32 is shown at upper diverter 146.

As seen in FIG. 8D, skylight frame 132 is secured by a series of fasteners 300 to rail and closure structure 140 at side rails 142 and 144, and rails 142 and 144 are secured to ribs 32 by a series of fasteners 310.

In the process of installing a skylight system of the invention, a short length of one of the ribs 32, to which the closure support structure is to be mounted, is cut away, forming gap 122 in the respective rib, to accommodate drainage at that end of the rail and closure structure which is relatively closer to ridge cap 120. Such gap 122 is typically used with standing seam, architectural standing seam, and snap seam roofs, and can be used with any other roof system which has elevated elongate joints and/or ribs.

The retained portions of rib 32, namely along the full length of the skylight as disposed along the length of the respective roof panel, provide beam-type structural support, supporting side rails 142 and 144 and maintaining the conventional watertight seal at the joints between roofing panels, along the length of the assembly. Portions of ribs 32, inside cavity 274, may be removed to allow additional light from skylight lens 130 to reach through the respective roof opening.

As part of the installation of upper diverter 146, a stiffening plate structure 148, illustrated in FIG. 7 and following the width dimension contour of the roof panel, is placed against the bottom surface of the respective roof panel at or adjacent the upper end of the opening in the roof. Self-drilling fasteners 430 (FIG. 7A) are driven through a lower flange of upper diverter 146, described more fully hereinafter, through the metal roof panel and into stiffening plate structure 148, drawing the diverter, the roof panel, and the stiffening plate structure into facing contact with each other and thus trapping the roof panel between the stiffening plate and the diverter and closing off the interface between the panel and the diverter. Thus, stiffening plate structure 148 acts as a nut for tightening fasteners 430. Caulk or other sealant can be used to further reinforce the closure sealing of the diverter/roof panel interface.

Stiffening plate 148 can also be used to provide lateral support, connecting adjacent ribs 32 to each other. Stiffening plate 148 is typically steel or other material sufficient to provide a rigid support to the skylight rail and closure structure at diverter 146.

Rail and closure structure 140 is configured such that the skylight subassembly can be fastened directly to the rails with rivets or other fasteners such as screws and the like as illustrated at 310 in FIG. 8D.

Looking now to FIGS. 7A, and 10 through 12, upper diverter 146 extends between rails 142, 144, and provides end closure, and a weather tight seal, of the rail and closure structure, at the upper end of the roof opening, and diverts water around the upper end of the opening, to the flat portion 114 of an adjacent panel. Diverter 146 generally fits the profile of the uncut rib 32 across the panel flat from the cut away gap 122. The upper ends of side rails 142 and 144 abut the downstream side of diverter 146 and the height of diverter 146 closely matches the height of the side rails. Bearing panel 400 of diverter 146 thus acts with bearing panels 240 of side rails 142 and 144, and an upper surface of lower closure 150, to form the upper surface of the rail and closure structure, to which the skylight lens frame 132 is mounted, as well as surrounding a space which extends upwardly from the corresponding opening in the roof panel.

Lower flange 410 of diverter 146 runs along, parallel to, and in general contact with, panel flat 14 of the respective roof panel. Fastener holes 430 are spaced along the length of lower flange 410 and extend through lower flange 410 for securing the lower flange to stiffening plate structure 148 in the panel flat, with the roof panel trapped between the lower flange and the stiffening plate structure. As illustrated, end panel 412 has a diversion surface 420. Diversion surface 420 is, without limitation, typically a flat surface defining first and second obtuse angles with lower flange 410 and with an upper web 415 of end panel 412. As indicated in FIG. 10, diversion surface 420 has relatively greater width "W1" on the side of the closure structure which is against the rib which is not cut, and a relatively lesser width "W2", approaching a nil dimension, adjacent rib gap 122, thus to divert water toward gap 122.

At the end of lower flange 410, which is closer to the closed rib, is a rib mating surface 440. At the end of lower flange 410 which is closer to the cut rib is a rib sealing portion 450 of upper web 415, which functions as an end closure of the rib 32 on the lower side of gap 122, and further functions to divert water across the respective rib 32 and onto the flat 14 portion of the roof panel. Rib sealing portion 450 extends through gap 122 and across the respective otherwise-open end of the rib. Hard rubber rib plugs 460, along with suitable tape mastic and caulk or other sealants, are inserted into the cut ends of the rib on both the upstream side and the downstream side of gap 122. The upstream-side plug, plus tube sealants, serve as the primary barrier to water entry on the upstream side of gap 122. Sealing panel portion 450 serves as the primary barrier to water entry on the downstream side of gap 122, with plug 460, in combination with tube sealant, serving as a back-up barrier.

The cross-section profiles of plugs 460 approximate the cross-section profiles of the cavities inside the respective rib 32. Thus plugs 460, when coated with tape mastic and tube caulk, provide a water-tight closure in the upstream side of the cut rib, and a back-up water-tight closure in the downstream side of the cut rib. Accordingly, water which approaches upper diverter 146 is diverted by diversion surface 420 and flange 410 and secondarily by web 415, toward sealing portion 450, thence through gap 122 in the rib, away from the high end of closure support structure 100 and onto the flat portion of the next laterally adjacent roof panel. Accordingly, so long as the flow channel through gap 122 remains open, water which approaches the skylight assembly from above upper diverter 146 is directed, and flows through, gap 122 and away from, around, the respective skylight assembly.

Figure 10:
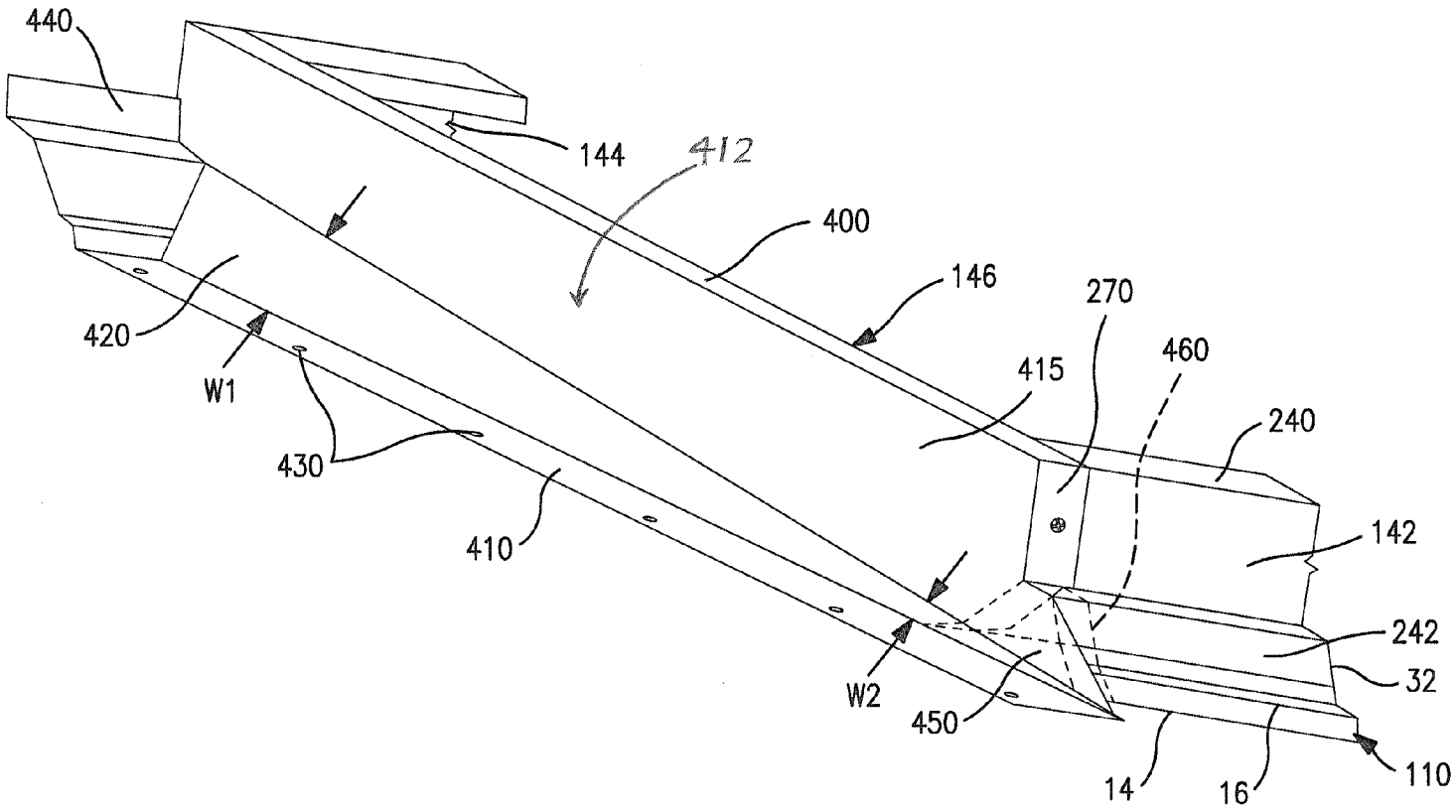
FIG. 10 is a perspective view of the upper diverter showing trailing closure flaps extending from the ends of the upper web of the upper diverter, and closed over the upright sides of the respective side rails.
Figure 11:
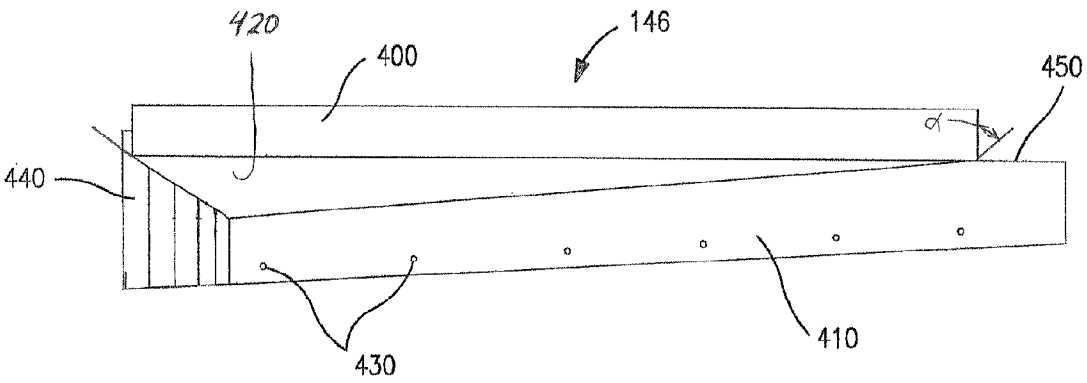
FIG. 11 is a top view of the upper diverter wherein trailing closure flaps extend from the ends of the upper web and define acute angles with upright sides of respective side rails, before the trailing closure flaps are closed over the upright sides of the side rails.
Figure 12:
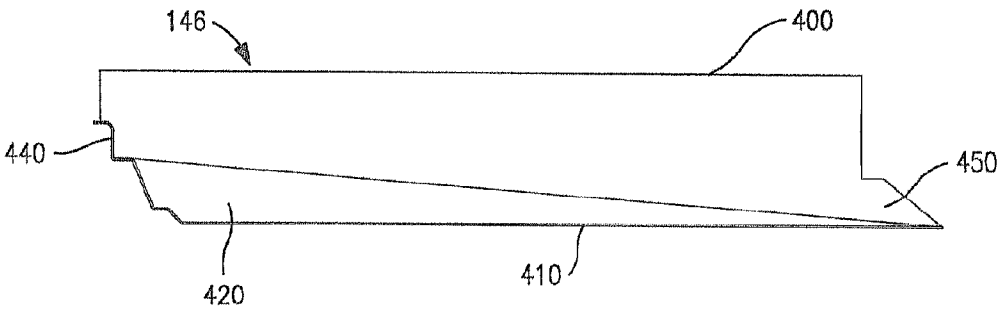
FIG. 12 is a front elevation view of the upper diverter of FIG. 11.

FIGS. 7A, 10, and 11 show diverter ears 270 on opposing ends of the upper diverter. Ear 270 is shown in FIG. 11, in top view, at an angle a of about 45 degrees to the end of bearing panel 400 of the diverter. FIG. 10 shows an ear 270 after the upper diverter has been assembled to a rail, and the ear has been bent flat against the respective upstanding web 238 of the rail. After the ear has been bent flat against the rail upstanding web, ear 270 is secured to upstanding web 238 by driving a screw through aperture 276 and into the upstanding web.

Figure 13:
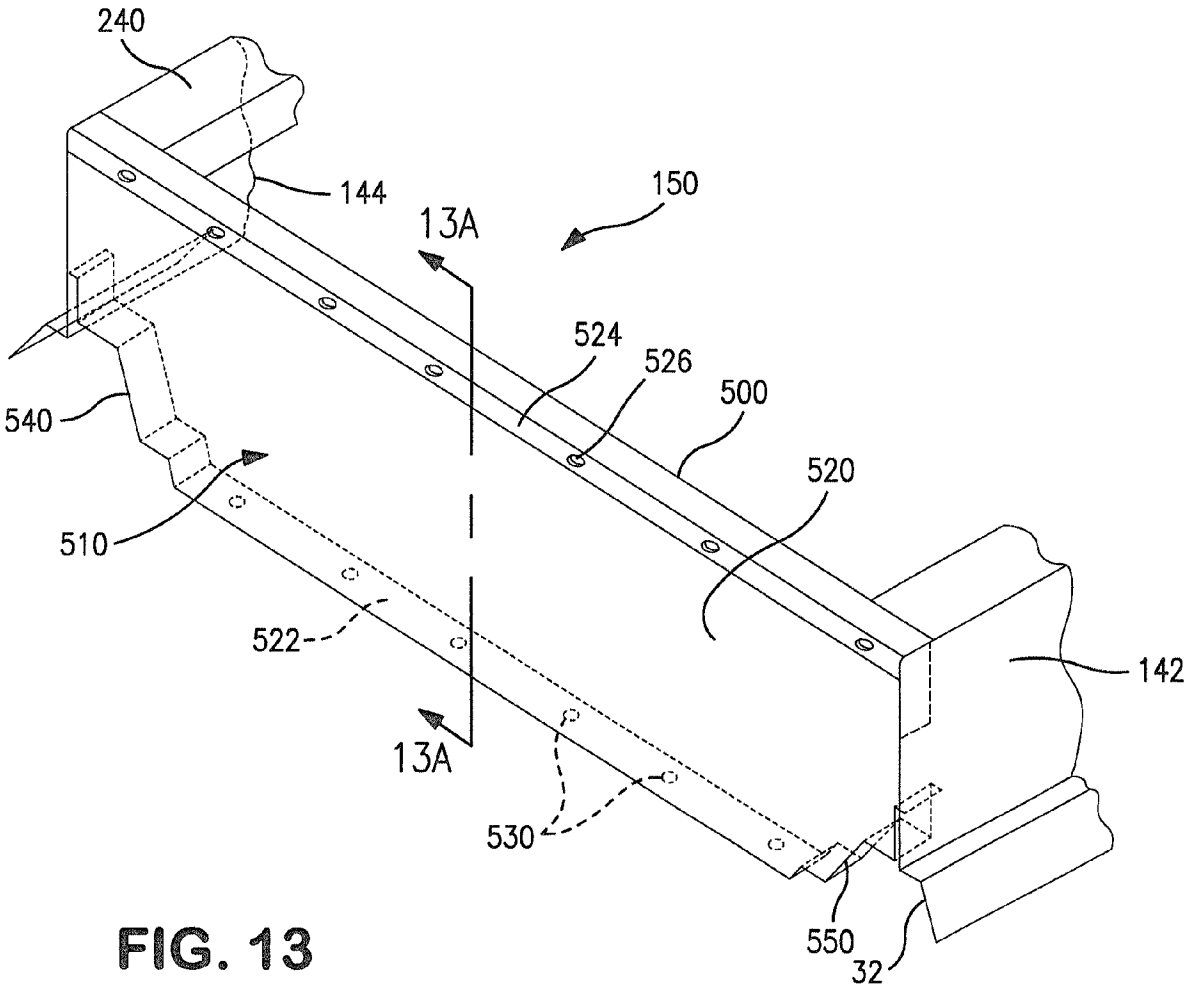
FIG. 13 is a perspective view of the lower closure.
Figure 15:
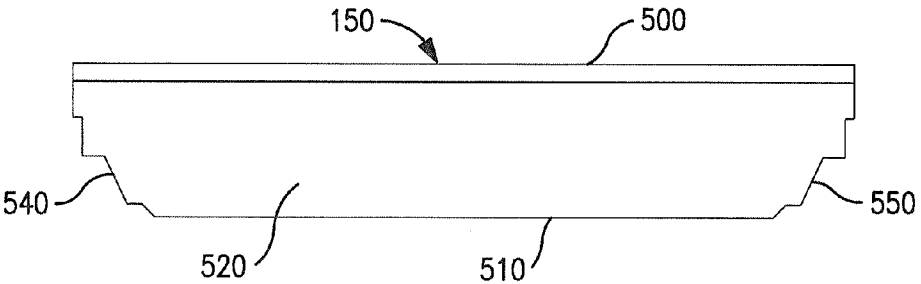
FIG. 15 is an elevation plan view of the lower closure.

FIGS. 9, 13, 13A, 14, and 15 show lower closure 150. The lower closure is used to establish and maintain a weather tight seal at the lower end of rail and closure structure 140, namely at the lower end of roof opening 249. As illustrated in FIGS. 9, 13, and 15, the bottom of closure 150 is contoured to follow the profiles of ribs 32, thus to extend up a cross-section of a rib in surface-to-surface relationship with, as well as to follow, the contour of panel flat 14 across the width of the panel. Bottom closure 150 abuts the lower ends of side rails 142 and 144, and the height of closure 150 matches the heights of side rails 142, 144.

Figure 13A:
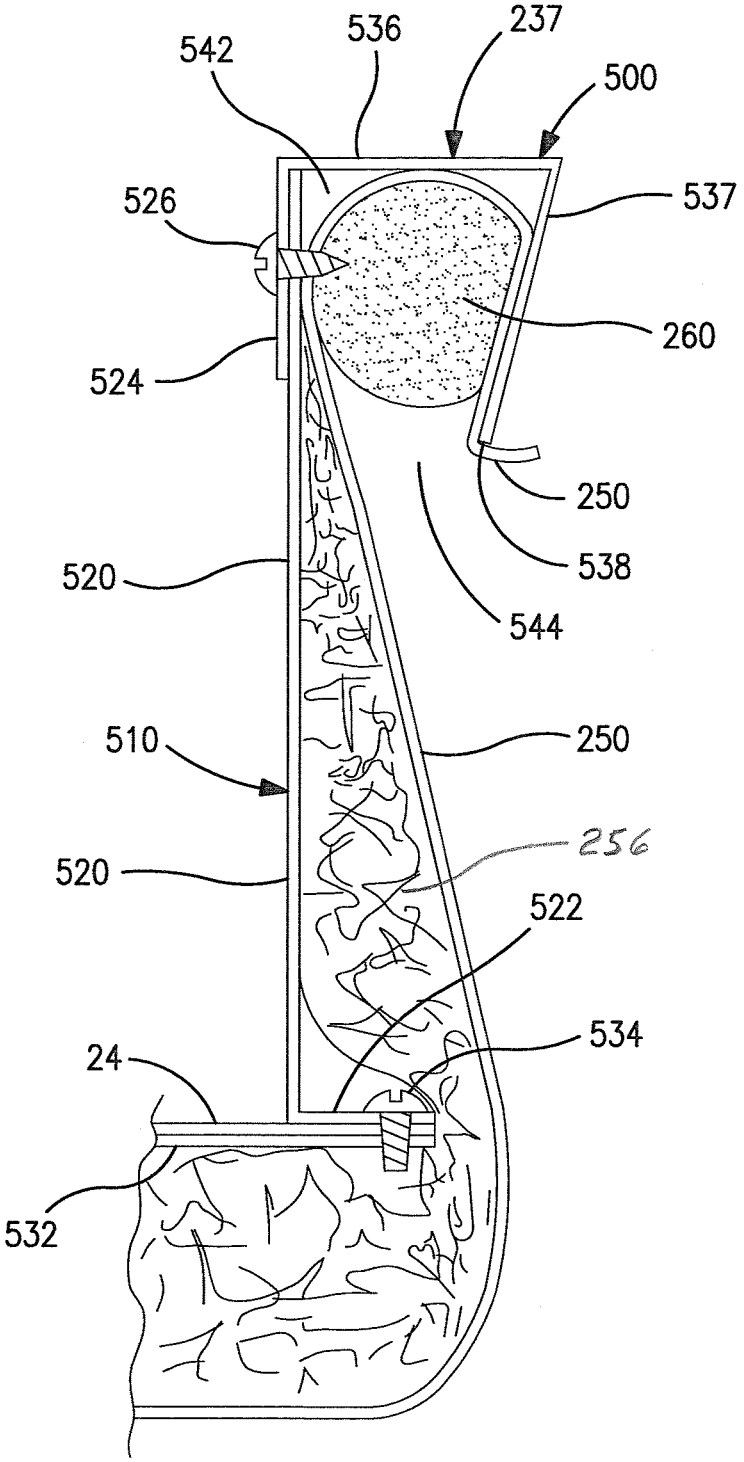
FIG. 13A is a cross-section taken at 13A-13A of FIG. 13, showing the relationships between the bottom portion of the lower closure and the overlying flange, showing the insulation facing sheet being held in the flange cavity by the retainer rod, with the screws which mount the overlying flange to the bottom portion being embedded in the retainer rod, and showing a reinforcing plate under the flat of the metal roof panel at the lower closure, whereby the joint between the bottom flange of the bottom portion of the lower closure and the flat of the roof panel is supported by the reinforcing plate.
Figure 14:
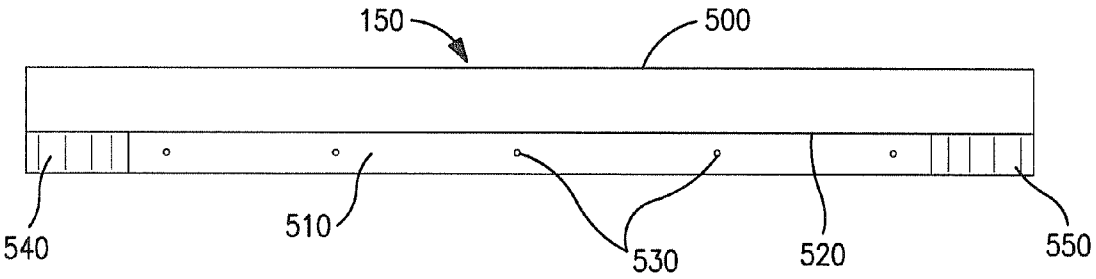
FIG. 14 is a top view of the lower closure.

Referring to FIGS. 13, 13A, lower closure 150 has a bottom portion 510 and an upper rail 500 secured to the bottom portion. Bottom portion 510 has a lower flange 522, as well as a closure web 520. Lower flange 522 is in-turned, namely flange 522 extends inwardly of closure web 520, toward the roof opening and includes fastener holes 530. A stiff, e.g. steel, stiffener support plate 532 extends the width of the panel flat under lower flange 522. Self-drilling screws 534 extend through holes 530, through the panel flat, and into the stiffener support plate. Stiffener support plate 532 acts as a nut for the respective screws 534, whereby the screws can firmly secure the lower flange to the panel flat and providing support to that securement. Tube sealants can be used to enhance such closure.

Upper rail 500 is an elongate inverted, generally U-shaped structure. A first downwardly-extending leg 524 has a series of apertures spaced along the length of the rail, and screws 526 or other fasteners which extend through leg 524 and through closure web 520, thus mounting rail 500 to bottom portion 510.

Rail 500 extends, generally horizontally, from leg 524 inwardly and across the top of closure web 520, along bearing panel 536 to inside panel 537. Inside panel 537 extends down from bearing panel 536 at an included angle, between panels 536 and 537, of about 75 degrees to a lower edge 538.

Thus, the upper rail of the lower closure, in combination with the upper region of closure web 520, defines a cavity 542 which has a cavity cross-section corresponding with the cross-sections of cavities 264 of rails 142, 144. As with cavities 264 of the side rails, foam retaining rod 260 has been compressed in order to force the rod through slot 544, capturing facing sheet 250 between the retaining rod and the surfaces which define cavity 542. The facing sheet has been raised. Facing sheet 250 traverses cavity 542 along a path similar to the path through cavities 264. Thus, facing sheet 250 enters cavity 542 against the inner surface of closure web 520, extends up and over/about rod 260 in the cavity, against panels 536 and 537, and back out of cavity 542 to a terminal end of the facing sheet outside cavity 542. The tension on facing sheet 250 holds edge portion 256 of the batting against bottom portion 510 of the lower closure.

The uncompressed, rest cross-section of rod 260 in cavity 542 is somewhat greater than the cross-section of slot-shaped opening 544 between inside panel 537 and closure web 520, whereby rod 260 is necessarily compressed while being inserted through slot 544 and into cavity 542. After passing through opening 544, rod 260 expands against panels 524, 536, and 537 of the cavity while remaining sufficiently compressed to urge facing sheet 250 against panels 524, 536, and 537 whereby facing sheet 250 is assuredly retained in cavity 542.

As with screws 300 which mount the skylight assembly to side rails 142, 144, upper diverter 146, and lower closure 150, screws 526 extend through rail 500, through closure web 520, and into rod 260, whereby rod 260 insulates the inside of the roof opening from temperature differentials transmitted by screws 526, thereby to avoid the fasteners being a source of condensation inside space 274 below the skylight lens.

Upper rail 500 of the lower closure extends inwardly, toward opening 249, of closure web 520 at a common elevation with bearing panels 240 of the side rails. Collectively, the bearing panels of side rails 142, 144, lower closure 150, and upper diverter 146 form a consistent-height top surface of the rail and closure structure, which receives the skylight lens subassembly.

Closure 150 includes rib mating flanges 540 and 550, as extensions of lower flange 522, to provide tight fits along ribs 32.

A salient feature of support structures 100, relative to conventional curb-mounted skylights, is the reduction in the number of roof penetrations, namely roof openings, required to provide daylight lighting to the interior of e.g. a building, as multiple skylight assemblies can be mounted along the length of a single elongate opening in the roof, whereby fewer, though longer, openings can be made in the roof. Namely, a single opening in the roof can extend along substantially the full length of a roof panel, if desired, rather than cutting multiple smaller openings along that same length, and wherein the single opening can provide for an equal or greater quantity of ambient light being brought into the building through a smaller number of roof openings.

Another salient feature of support structures 100, relative to conventional curb-mounted skylights, is the fact that the full lengths of the entireties of the sides, namely the side rails, are above the panel flats, namely above the typical high water lines of the respective metal roof panels.

Yet another salient feature of support structures 100, relative to conventional curb-mounted skylights, is the provision of lateral leg 147 of the upper diverter, which diverts water laterally away from the upper end of the skylight installation support structure.

Figure 16:
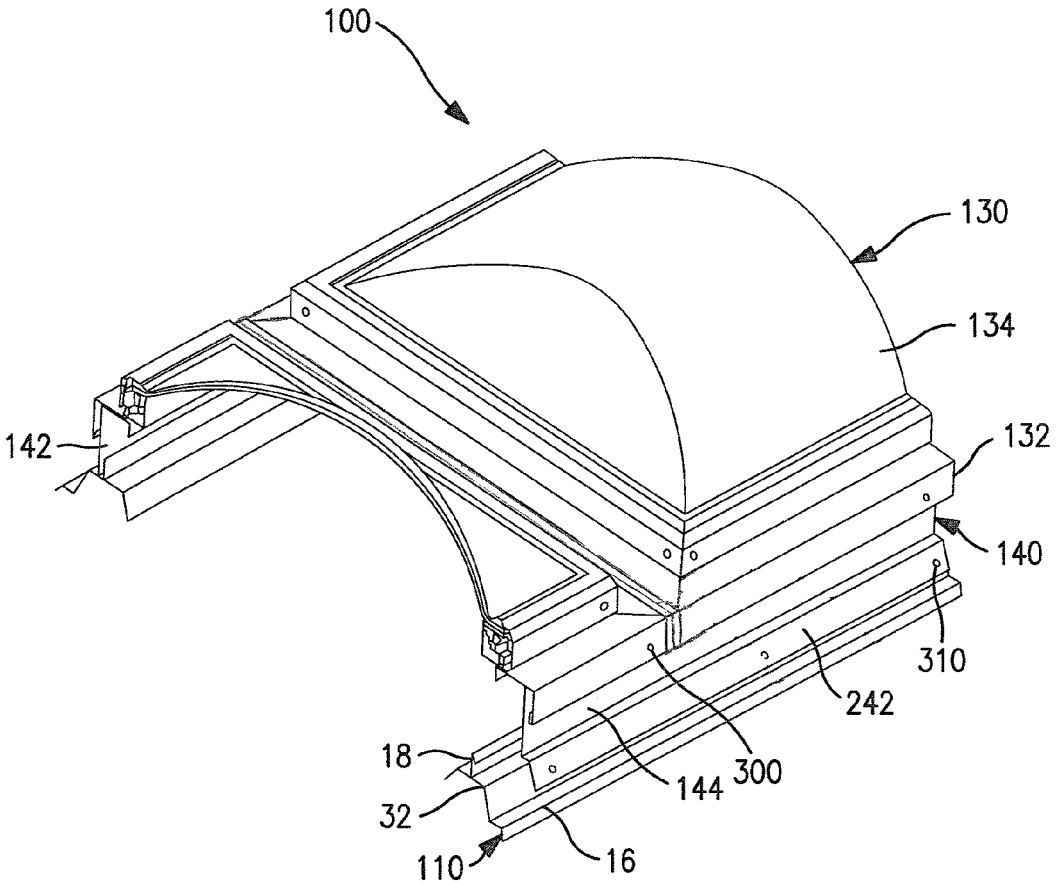
FIG. 16 is a perspective view, partially cut away, showing an end joint between facing ends of adjacent skylights of the system.
Figure 17:
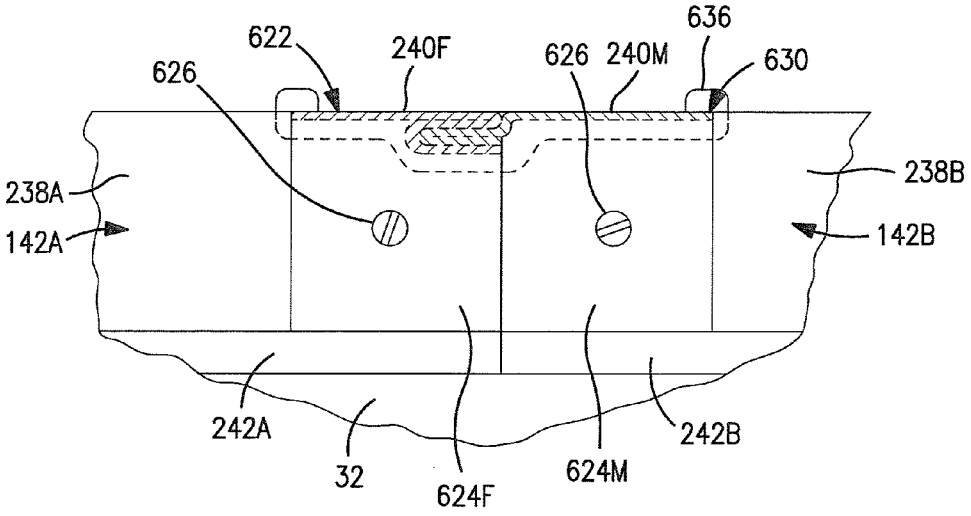
FIG. 17 shows additional detail of the joint between facing ends of adjacent skylights.
Figure 18:
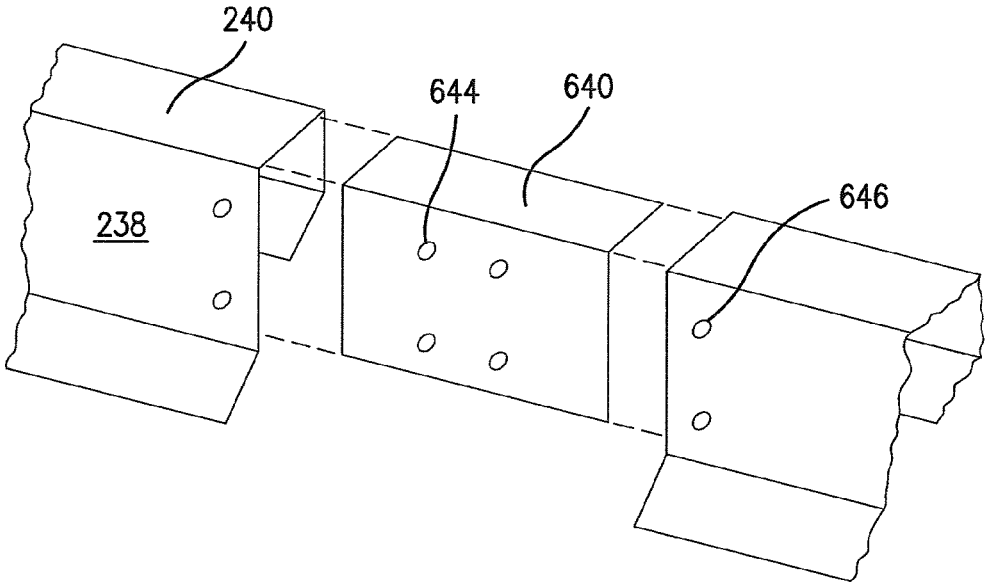
FIG. 18 shows an exploded pictorial view of a rail connector aligned with abutting rail ends and wherein the connector bridges the butt joint between rails which adjoin each other end to end, thus providing both reinforcement of the joint and enhanced sealing of the joint against intrusion of water.

Support structures of the invention are particularly useful for continuous runs of e.g. skylights, where individual skylights are arranged end to end between the ridge and the eave of a roof. FIGS. 16, 17, and 18 show how the ends of two rails can be joined to each other end to end, in a strip of such skylight assemblies. Instead of installing an upper diverter and a lower closure with each of multiple skylight assemblies, rail 142A under the relatively upstream skylight abuts rail 142B under the relatively downstream skylight, rails 142A, 144A being mounted by rail shoulders 242A, 242B to rib 32. A female mating strip 622 extends across opening 249 at the lower ends of a first pair of rails 142, 144, between rail 142A and the corresponding rail 144 on the other side of the opening in a constant cross-section illustrated in dashed outline in FIG. 17. The extension of female mating strip 622 across the opening includes a bearing panel 240F which extends between the opposing rails generally designated 142, 144. Securing panels 624F extend beyond both ends of bearing panel 240F and down over upstanding webs 238, only one panel 624F being shown, on the opposing rails 142, 144. Securing panels 624F extend down from bearing panel 240F and are secured to upstanding webs 238 by screws 626.

A male mating strip 630 extends across opening 249 at the upper ends of a second pair of rails 142, 144, between a rail 142B and the corresponding rail 144, on the other side of the opening in a constant cross-section illustrated in dashed outline in FIG. 17. The extension of male mating strip 630 across the opening includes a bearing panel 240M which extends between the opposing rails generally designated 142, 144. Securing panels 624M extend beyond both ends of bearing panel 240M and down over upstanding web 238B, only one panel 624M being shown, on the opposing rails 142, 144. Securing panels 624M extend down from bearing panel 240M and are secured to upstanding webs 238 by screws 626.

Female mating strip 622 has a generally horizontally oriented elongate receptacle/slot under the trailing edge of bearing panel 240F. Male mating strip 630 has a generally horizontally oriented elongate protuberance stepped down from bearing panel 240M and extending from the leading edge of bearing panel 240M. A protuberance on the male mating strip is received in the female receptacle, thus to make the joint across opening 249 for receiving the end members of the frame 132 of the relatively upstream and relatively downstream, skylight assemblies in the respective skylight strip assembly. A bead of tube sealant is laid in the female receptacle before the protuberance is mated with the receptacle.

Additional tube sealant is applied along the tops of mating strips 622 and 630 where bearing panels 240F and 240M meet.

A thin strip of thermally insulating foam 636 can be applied to the bottom surfaces of mating strips 622 and 630, bridging the joint and secured temporarily to the tops of bearing panels 240F, 240M. Placement of first and second skylight assembly frames 132 on the respective bearing panels 240F, 240M then secures the ends of the foam on the tops of the mating strips.

Mating strips 622 and 630 have been shown with the female slot/receptacle and the male protuberance in horizontal orientations. Similar mating strips can as well be designed wherein the male protuberance extends upwardly from bearing panel 240M; and the female receptacle is defined by a wall which extends upwardly from bearing panel 240F to a top, and then downwardly in defining a downwardly-opening elongate slot. Once again, the female mating strip is typically on the relatively upstream side of the joint and the male mating strip is on the relatively downstream side of the joint.

In the process of installing the closure support structure, the upper diverter is installed first, after cutting a small portion of the opening near the diverter. Then the remainder of the roof opening is cut in the respective roof panel and the rails are installed. The lower closure and mating strips are then installed, which defines the perimeter bearing surfaces for each skylight assembly. The skylight assemblies are then mounted on their perimeter bearing surfaces and secured to the rails. Tube sealant and tape mastic are applied, as appropriate, at the respective stages of the process to achieve leak-free joints between the respective elements of the closure assembly.

The rails, with or without the upper diverter or the lower closure, depending on the presence, or not, of an opening in the roof, can be installed on major rib elevations for any of the aforementioned roof panel profiles relative to the included flat portion of the respective roofing panel, so long as the rib structure can adequately support the contemplated load.

Skylight assemblies of the invention can be connected end to end for as long a distance as necessary to cover a roof opening, as each skylight assembly unit is supported by the ribs 32 of the respective roof panel through respective rails 142, 144. The full collective lengths of the respective rails, regardless of the number of skylight assemblies which are used to close off a given opening in the roof, can extend longitudinally along the standing rib elevations.

Water cannot enter over the tops of the rails because of the sealant at 330. Water cannot enter at the upper diverter at, the uppermost skylight assembly because of the seal properties provided by the upper diverter, by bearing plate 148, and by the respective sealants, as well as because of the diversion of water away from the upper end of the strip of skylights through gap 122 which prevents any substantial quantity of water from standing on a panel 10 against upper diverter 146 for any extended period of time. Water cannot enter at the lower end because of the seal properties provided by the lower closure and by the sealants between the lower closure and the respective roof panel. Water cannot enter between the ends of the skylight subassemblies because of the tortuous path through receptacle slot 632 in combination with the sealants applied at the end-to-end joint.

FIG. 18 shows an exploded pictorial view of the ends of first and second rails in abutting relationship, which abutting relationship is also illustrated in part in FIG. 7, such as where first and second skylights are arranged in end-to-end relationship over a single roof opening. Connector 640 is configured to fit closely inside the cavity cross-sections defined by the respective rails, against the upstanding webs 238 and against the rail bearing panels 240. Connector 640 is shown aligned with the abutting rail ends. The connector is inserted into the cavities in the rails, bridging the butt joint between the rails. Apertures 644 in the connector align with apertures 646 in the rails when the ends of the rails are in abutting relationship. Screws or other known aperture-to-aperture fasteners are used to securely fasten connector 640 to both of the rails. Tape mastic and tube caulk are used, as known in the art for water seal closures, to fill the joint between the rail panels and reinforcing connector 640. Connector 640 thus provides both reinforcement of the joint and enhanced seal of the joint against intrusion of water.

As indicated above, the weight of a load transferred by rails 142, 144 is transferred directly to ribs 32 of the respective underlying roof panels, optionally along the full lengths of the support structure; and only a minor portion, such as less than 10% if any, of that weight is borne by the panel flat, and only at the high end and at the lower end of the support structure. Thus, the weight of the rails, or of the rail and closure assembly, is borne by the strongest elements of the roof panels, namely the ribs.

Figure 19:
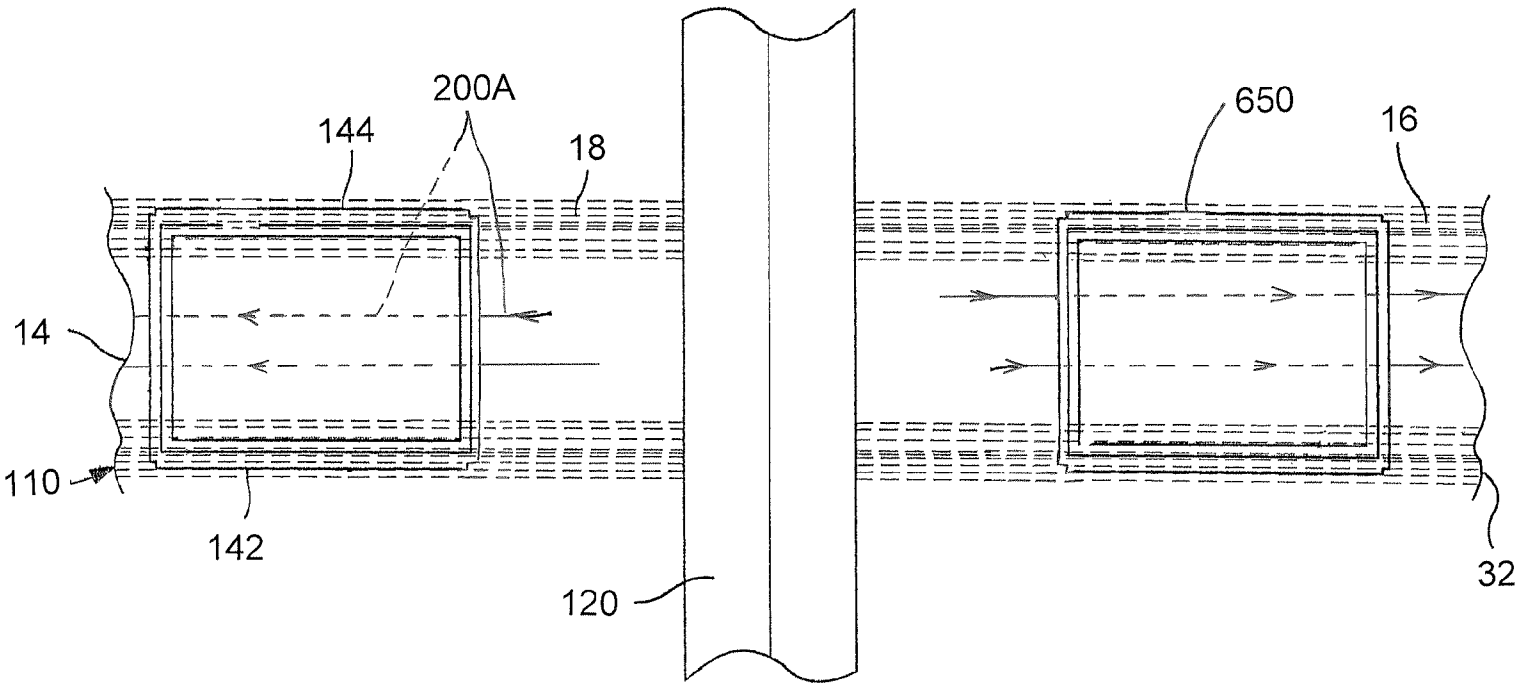
FIG. 19 a top plan view of an installed load such as an air conditioner or an electrical panel, which does not require any substantial opening in the roof.

A wide variety of roof-mounted loads 650, in addition to skylights and smoke vents, are contemplated to be mounted on rails 142, 144, so long as the weight of such roof-mounted loads does not exceed the allowable load on the ribs. As illustrated in FIG. 19, where the load is e.g. an air conditioner or electrical panel, which does not require any substantial opening in the roof, the upper diverter and the lower closure can be omitted. Where the upper diverter and lower closure are omitted, nominally 100% of the load passes through rails 142, 144 to ribs 32, as elements of the roof panels, and thence to the building structural members, and the panel flat between the first and second rails is sufficiently unobstructed proximate the load that rain water freely flows down the panel flat between the first and second rails and continues to flow along the same panel flat under the load, as illustrated by the arrows 200A, from an up-slope end of the load to a down-slope end of the load. While the rails can extend onto an intervening panel flat, such is not the typical case. Rather, the rails are confined to the ribs, with the load spanning the panel flat above the ribs.

Further, where the upper diverter and lower closure are omitted, the rails can extend intermittently along the lengths of ribs 32, or shorter lengths of rails 142, 144, such as about 6 inches to about 12 inches length of such rails, can underlie only the left and right sides of upper and lower ends of the load.

The primary reason why the disclosed rail and closure structures do not leak is that a great portion of the perimeter of the closure, namely that which is defined by side rails 142, 144, is above the panel flat, namely above the normal high water line on the roof panel; and all associated roof penetrations, such as screws 310 which mount the rails to the ribs, are above the water line. With little or no standing water at the joints between the rails and the roof panels, even if the sealant fails at a joint, no substantial quantity of water routinely enters such failed joint because of the heights of such joints above the water line.

As a general statement, rail and closure structures of the invention close off the roof opening from unplanned leakage of e.g. air or water through the roof opening. The rail and closure structure 140 extends about the perimeter/sides of the roof opening and extends from the roofing panel upwardly to the top opening in the rail and closure structure. The lens subassembly overlies the top opening in the rail and closure structure and thus closes off the top opening to complete the closure of the roof opening.

Support structure 100 thus is defined at least in part by rail and closure structure 140 about the perimeter of the roof opening, and skylight lens subassembly 130, or the like, overlies the top of the rail closure structure and thus closes off the top of the closure support structure over the roof opening.

Rail and closure structure 140 has been illustrated in detail with respect to one or more variations of the standing seam roofs illustrated in FIGS. 1, 3, and 5. In light of such illustrations, those of skill in the art can now adapt the illustrated rail and closure structures, by modifying, shaping of the structure elements, to support loads from any roof system which has a profile which includes elevations, above the panel flat, using standing joints or other raised elevations, such as, without limitation, those illustrated in FIGS. 2 and 4, as the locus of attachment to the roof.

While the figures depict a skylight, the rail structure, with or without end closures, can be used to mount a wide variety of loads on such roof, including various types of skylights, smoke vents, air conditioning, other vents, air intakes, air and other gaseous exhausts, electrical panels or switching gear, and/or other roof loads, including roof-penetrating structures, all of which can be supported on rail structures of the invention.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A sloping metal roof on a budding, said sloping metal roof comprising:

a plurality of elongate metal roof panels arranged side by side, such roof panels having lengths and widths, (i) edges of adjacent such roof panels meeting at elevated rib structure portions thereof, whereby said roof panels thereby define elevated roof panel ribs, having lengths, and (ii) panel flats being disposed between said elevated roof panel ribs, a load being mounted on said roof, said load comprising a supported member, and a load support structure supporting said supported member, said load support structure comprising at least first and second rails having lengths generally aligned with the lengths of said roof panel ribs, an upper diverter and a lower closure, said rails being secured to first and second underlying ones of such roof panel ribs, said upper diverter having a length extending in the direction of the width of a respective one of said roof panels, a lower edge of an end panel of said upper diverter extending, from a relatively up-slope end of said lower edge at a first side of said load support structure, along a downwardly directed slope, across a width of the respective metal roof panel to a second side of said load support structure thereby to direct water, flowing toward said load support structure, laterally in a single direction across the width of said load support structure.

2. A sloping metal roof system on a building, said sloping metal roof system comprising:

(a) a metal roof comprising a plurality of elongate metal roof panels arranged side by side, such roof panels having lengths, (i) edges of adjacent such roof panels meeting at elevated rib structure portions thereof, whereby said roof panels define elevated roof panel dbs, having lengths, and (ii) intervening panel flats being disposed between said elevated roof panel ribs, (b) a load support structure mounted on said roof, said load support structure comprising at least first and second side rails having lengths generally aligned with the lengths of said roof panel ribs, said rails being secured to first and second underlying ones of such roof panel ribs; and (c) a load supported by said load support structure, said first and second side rails not extending onto the intervening panel flat between said such first and second ribs, said load spanning the panel flat above the first and second ribs whereby, when viewed from a top plan view, rain water flows down such panel fiat between said first and second rails and flows under said load and between said load and such panel flat.

3. A sloping metal roof as in claim 1, said lower flange of said upper diverter extending through a gap in said second rib in proximity to both up-slope and down-slope cut ends of the second rib at such gap.

4. A sloping metal roof as in claim 3 wherein no gap is cut in said first rib such that all water flowing down slope on said roof to said upper diverter is directed through the gap in said second rib.

5. A sloping metal roof system on a building, said sloping metal roof system comprising:

(a) a metal roof comprising a plurality of elongate metal roof panels arranged side by side, such roof panels having lengths, (i) edges of adjacent such roof panels meeting at elevated rib structure portions thereof, whereby said roof panels define elevated roof panel ribs, having lengths, and (ii) intervening panel flats being disposed between said elevated roof panel ribs, (b) a load support structure mounted on said roof, said load support structure comprising at least first and second side rails having lengths generally aligned with the lengths of said roof panel ribs, said rails being secured to first and second underlying ones of such roof panel ribs; and (c) a load supported by said load support structure, said first and second side rails not extending onto the intervening panel flat between said first and second side rails, said load spanning the panel flat above the first and second ribs whereby, when viewed from a top plan view, water flows down such panel flat between said first and second rails and continues to flow along the same panel flat under said load and between said load and such panel flat.

* * * * *